US006261012B1

(12) United States Patent
Haas et al.

(10) Patent No.: US 6,261,012 B1
(45) **Date of Patent: *Jul. 17, 2001**

(54) PRINTER HAVING AN INTERMEDIATE TRANSFER FILM

(75) Inventors: Darren W. Haas, Eden Prairie; Robert E. Francis, Richfield; Gary B. Fulmer, Eden Prairie; Thomas J. Reynolds-Kotz, Burnsville; Brent D. Lien, Minneapolis; John P. Skoglund, Savage; Matthew K. Dunham, Eagan; Gary M. Klinefelter, Eden Prairie, all of MN (US)

(73) Assignee: Fargo Electronics, Inc., Eden Prairie, MN (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/310,077

(22) Filed: May 10, 1999

(51) Int. Cl.[7] ..... B41J 35/28

(52) U.S. Cl. ..... 400/208; 400/120.02; 400/611; 156/265; 347/40; 347/43

(58) Field of Search ..... 400/208, 120.02, 400/120.04, 120.18, 708, 587, 611, 613, 618, 619, 635; 101/492, 211, DIG. 42; 156/265, 502, 358, 359, 360, 235, 249, 386, 542; 347/40, 43

(56) References Cited

U.S. PATENT DOCUMENTS

| | | | |
|---|---|---|---|
| 3,434,902 | 3/1969 | Bliss . | |
| 3,857,527 | 12/1974 | Kranz | 242/75.5 |
| 3,879,924 * | 4/1975 | Walker | 156/265 |

(List continued on next page.)

FOREIGN PATENT DOCUMENTS

| | | |
|---|---|---|
| 0 442 762 | 8/1991 | (EP) . |
| 3-234670 | 10/1991 | (EP) . |
| 8-66999 | 3/1996 | (EP) . |
| WO 98/16394 | 4/1998 | (WO) . |
| WO 98/24632 | 6/1998 | (WO) . |
| WO 99/04080 | 1/1999 | (WO) . |

*Primary Examiner*—Eugene Eickholt
(74) *Attorney, Agent, or Firm*—Westman, Champlin & Kelly, P.A.

(57) ABSTRACT

A printer for printing information on images on a substrate such as an identification card in multiple colors has an intermediate transfer film or web on which a reverse image is printed. The printer has a lamination station where the image is transferred to a substrate, such as an identification card. The intermediate transfer film or web is moved back and forth, the intermediate transfer film or web has slack occurring in it between the printing station and the lamination station. The slack is taken up with spring loaded rollers to permit operation of the printer head and the lamination station at the same time. Additionally, the printer is made into modules that are movable for easy access to interior components and to expose film or web paths that permits installing both the print film or web and the intermediate transfer film or web without threading it through enclosed openings.

44 Claims, 16 Drawing Sheets

U.S. PATENT DOCUMENTS

| | | | | |
|---|---|---|---|---|
| 4,300,974 | | 11/1981 | Bauer | 156/360 |
| 4,617,080 | | 10/1986 | Kobayashi et al. | 156/359 |
| 5,190,234 | * | 3/1993 | Ezekiel | 156/502 |
| 5,238,524 | | 8/1993 | Seki et al. | 156/538 |
| 5,277,501 | | 1/1994 | Tanaka et al. | 400/120 |
| 5,437,960 | | 8/1995 | Negate et al. | 430/256 |
| 5,447,566 | * | 9/1995 | Loiacond | 101/228 |
| 5,484,215 | | 1/1996 | Fillod et al. | 400/120.18 |
| 5,484,502 | | 1/1996 | Bozanic | 156/235 |
| 5,503,702 | | 4/1996 | Filicicchia et al. | 156/249 |
| 5,614,058 | | 3/1997 | Didelot et al. | 156/542 |
| 5,626,699 | | 5/1997 | Didelot et al. | 156/99 |
| 5,697,297 | * | 12/1997 | Rasmussen | 101/211 |
| 5,729,817 | * | 3/1998 | Raymond et al. | 400/635 |
| 5,735,994 | | 4/1998 | Lappe et al. | 156/386 |
| 5,765,481 | * | 6/1998 | Tortora et al. | 101/211 |
| 5,790,924 | | 8/1998 | Creutzmann et al. | 399/110 |
| 5,807,461 | | 9/1998 | Hagstrom | 156/361 |
| 5,820,277 | | 10/1998 | Schulte | 400/223 |
| 5,825,392 | | 10/1998 | Mochizuki | 347/197 |
| 5,850,248 | | 12/1998 | Bellemore | 347/262 |

* cited by examiner

PRINTER HAVING AN INTERMEDIATE TRANSFER FILM

BACKGROUND OF THE INVENTION

The present invention relates to a printer that uses an intermediate transfer film or web on which an image is printed by a printhead, after which the transfer film or web is registered with an identification card or other substrate to be printed and the image from the intermediate transfer film or web is laminated onto the card. The printer includes driven rollers and a dancer arm to create slack on one side of the film or web that permits the intermediate transfer film or web to move back and forth for multi-colored printing while the portion that will be laminated onto the card is not moved, or is moved at a different rate. Access to the print film or web and intermediate film or web transfer paths is simplified with modular components that are coupled together.

One prior art approach to producing printed identification cards is to print data directly onto the surface of the plastic card. The image on the surface of the card is susceptible to damage from abrasion, chemicals and radiation. To reduce or eliminate exposure of the printed material data, a protective film is laminated over the printed material.

Minnesota Mining and Manufacturing Company of St. Paul, Minn. (3M) has developed a material D12500 for printing a reverse image of the data on the under side of a protective film, and then the protective film is stacked onto a base substrate with the printed side next to the base substrate. Heat and pressure are applied to the flat card surfaces, and the stacked materials are fused into a solid composite by melting.

Dai Nippon Printing (DIP) of Japan has an intermediate transfer process that involves printing a reverse image of the data that is desired on a card on the under side of the protective film used. The Dai Nippon Process prints to an intermediate transfer web or film such as that used in this invention, and allows the intermediate transfer film to be transferred to the base substrate without requiring the film and base substrate to melt or fuse. In a dye sublimation process, multiple colors can be printed onto an intermediate transfer film or web, but it requires movement of the intermediate transfer film or web back and forth during the printing process so that multiple passes of printing occur.

SUMMARY OF THE INVENTION

The present invention relates to a printer which, as shown, prints a single color or a multicolor image onto an intermediate transfer film or web. The intermediate transfer film or web or web has a printable coating on one surface, and an image which may be direct or reversed from that which is desired on a substrate (identification card) is printed directly onto the intermediate transfer film or web using normal dye sublimation printing techniques or ink jet printing, or any other printing that will provide the colors and quality desired. The intermediate transfer film or web then carries the desired printed image that is to be placed onto an identification card, or other substrate, and the printed image is moved to a station for laminating the portion or panel of the film or web carrying the image onto a card through the use of heated lamination techniques for activating the print receptive coating on the intermediate transfer web or film.

The printer assembly of the present invention permits multiple back and forth passes of the intermediate transfer film or web in the printing section of the printer while the portion of the intermediate transfer film or web that is held in the laminator section does not move or does not move the same amount. The card and intermediate transfer film or web do not move bi-directionally in the laminator section. As the intermediate transfer film or web is moved back and forth at the print head, particularly when a single dye sublimation printhead and a multi color ribbon is used, slack is created between the laminator and the color printhead. Spring loaded slack take-up rollers or dancer rollers take up the slack so the film or web remains under control. A printed image can be laminated onto a card in one portion of the printer assembly while the printing of a reverse image onto the intermediate transfer film or web is occurring in another portion of the printer. This leads to increased production.

The lamination techniques used are well known, and utilize a heated roller. The temperature of the roller softens the card and affects the straightness or flatness of the card, and the present invention also includes at least one card straightener section after the laminator. As shown also in one aspect of the invention, a substrate inverter or flipper can be provided to invert the substrate or card and transfer an image to an opposite surface of the substrate or card, so that printing appears on both sides.

A clear film overlay chip protection layer can be laminated over one or both sides of the card after the image from the intermediate transfer web or film has been laminated to the card. This station can be between the intermediate transfer film or web laminator and the card straightener, or it can be after the card straightener shown. If the laminated chip protection layer is applied after the intermediate transfer film protection layer, a second card straightener can be provided following the second lamination.

The section of the printer that has the thermal dye sublimation film or web and printhead for printing onto the reverse image film or web is mounted in a first module that can be folded out from other modules of the printer, including a second module that carries the intermediate transfer film or web supply and take-up rollers, which can be folded out in an opposite direction from the first module. This permits both modules to have mounting rollers and supply and take-up rollers open and accessible for ease of installation of the film or web, including the thermal transfer film or web on the first module, and the intermediate transfer film or web on the second module. The lamination station is also mounted on the second module and intermediate transfer film or web will pass over the lamination roller and will easily be installed.

DETAILED DESCRIPTION OF THE PREFERRED EMBODIMENTS

Figure 1:
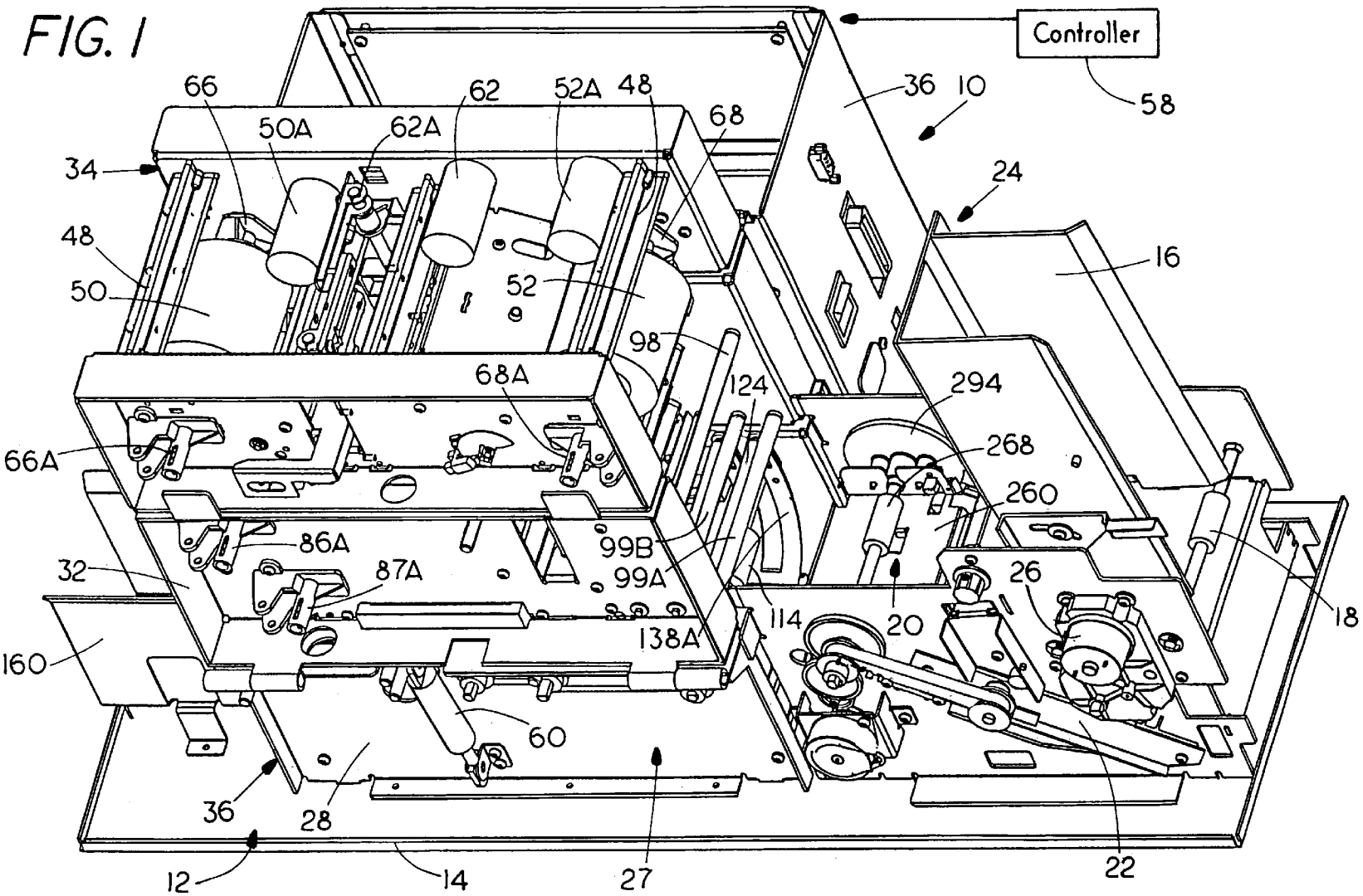
FIG. 1 is a perspective view of a printer made according to the present invention with the outer cabinet removed.

A printer assembly illustrated generally at 10 includes a frame 12. The frame has a base plate 14, and this is used for supporting various separable modules as will be more fully explained. The base plate 14 supports a card feeder module 24 including an identification card hopper 16, that has feed rollers 18 for feeding a card onto a card handling indexing or flipper table 20. The card can be encoded at an encoding station 22 as shown. The indexing table can be rotated to align the card with the encoding station, insert it retrieve it, and send it to the lamination station for placing an image on it. The indexing assembly is shown in more detail in FIGS. 16 and 17 and can be used for receiving a card from back from the laminator and inverting it and then driving it to the laminator for adding an image to a second side of the card, as will be explained.

The card feeder module 24 can be of any desired type, but the card feeder shown is described in co-pending U.S. patent application Ser. No. 09/310770, filed on May 10, 1999, entitled "Input Hopper And Encoding Station For Card Printer" and assigned to the same Assignee and incorporated by reference. Thus, details of the card feeder are not shown. The feeder does include a drive motor indicated at 26 for driving the cards onto the indexing table 20 and through the desired encoding processes in the encoding station 22. The frame 12 includes a base module 27 having a pair of upright side walls 28 and 30 that are spaced apart and form a main support for an intermediate transfer film or web module 32 and a thermal dye sublimation printer module 34. The frame 12 also supports a circuit board and power supply module 36, which mounts the circuit boards for the controller for the card feeder, printer, intermediate transfer film or web, laminator, and card straightener. A lamination station is indicated generally at 40 in FIG. 5. The lamination station 40 is in the base module 27 between the side walls 28 and 30. It is a conventional lamination station which has a heated roll that will laminate an image that has been printed onto the reverse image transfer film or web.

Printer Module

The thermal dye sublimation printer module 34, is mounted with suitable hinges 42, 42 to a side wall 44 of the circuit board and power supply module 36. It is latched and guided in place relative to other modules in its closed portion.

The printer module 34 has side walls 46, 46 that are spaced apart and are held together with suitable cross members 48, in a known manner. The side walls 46 are used to mount supports for a color film or web supply spool 50 and a color film or web take-up spool 52. These spools are mounted on supports 66, 66A, 68, 68A that permit connecting one end to a drive shaft of motor used with that roll in the normal manner and snap in supports for the opposite ends of the rolls. The film or web, which is shown schematically at 54, is preferably a dye sublimating film or web, but can be a resin film or web and also shown schematically in FIG. 4, passes underneath a thermal printhead 56 between the supply roll 50 and the take-up roll 52. Both the supply roll 50 and the take-up roll 52 are driven through suitable motors. In FIG. 1, the print film or web supply roller drive motor is indicated at 50A, and the print film or web take-up roller drive motor is indicated at 52A. These motors can drive the rollers with a direct drive or through suitable pulleys and/or gears, in a conventional manner. The motors are reversible stepper motors that can drive in forward and reverse direction. The motors are individually controlled. The respective supply spool or roller 50 and the take-up spool or roller 52 are driven as needed to register the proper color panels of the print film or web under the printhead. The print film or web 54 is fed and moved in accordance with a preselected program from a controller, which is shown schematically at 58. The controller 58 is programmed to respond to commands from an operator and sequentially carry out functions in response to preprogrammed sequence and sensor inputs. The back and forth motion can be used in batch printing as well as individual card printing, and the controls can be programmed to carry that function out.

The thermal color printhead 56 is a constructed and operated in known manner, and it is raised to permit the film or web 54 to be moved back and forth in a conventional manner for dye sublimation printing, or for other multi-color printing depending on the type of printer being used. The printhead is lowered to print from the thermal transfer film or web onto the intermediate transfer film or web, as backed by a printing platen 96. The printhead 56 can be of any desired type, such as an ink jet printer, as can the print film or web as long as it can print successfully to an intermediate transfer film or web. The printer is to print a reverse image onto an intermediate transfer film or web and then laminate that image onto a substrate such as an identification card. The modular arrangement of the sections is useful with all types of printers, and even when no intermediate transfer film or web is needed to print module can be mounted and opened relative to the base module for access.

Figure 3:
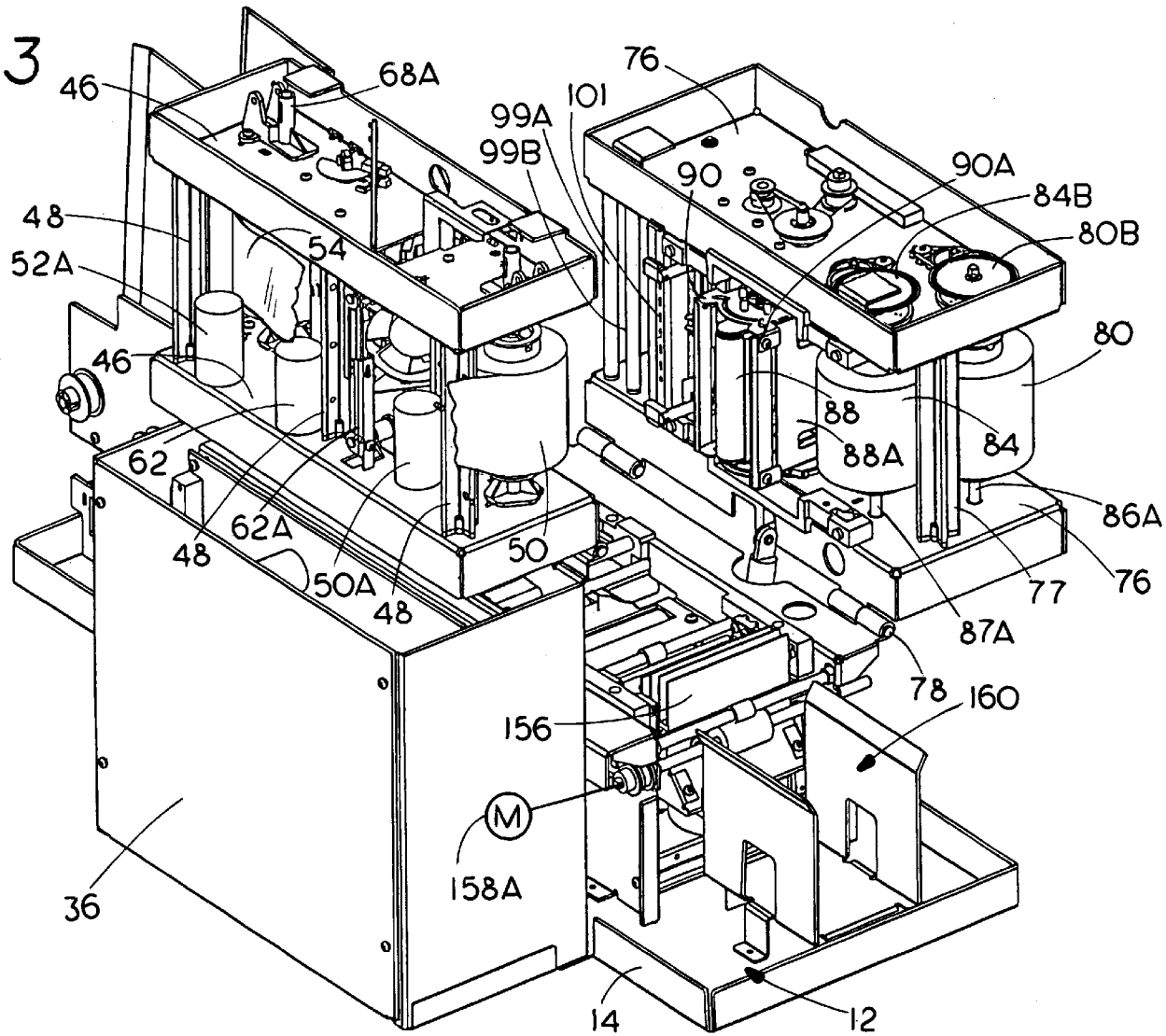
FIG. 3 is a perspective view with the modules hinged out from a base showing the supply, take-up and guide rollers for the intermediate transfer film or web.

The module 34 is supported in open position with a gas filled cylinder spring 60 that is mounted between a bracket on the side wall 44 and a bracket on the module 34 as shown in FIG. 3. The hinge 42 is sufficiently high, so that the module 34 will hinge out above the module 36.

The printhead 56, when it is a thermal printhead, is lifted and lowered at appropriate times with a suitable motor 62, shown in FIG. 1, in a conventional manner for thermal printheads. When the print film or web is moved, the printhead 56 is raised to relieve pressure on the print film or web against the intermediate transfer film or web and the platen 96 and to permit such movement. The lift linkage is indicated at 62A, and is driven through a gear set from motor 62. Again, this is a known arrangement.

Figure 2:
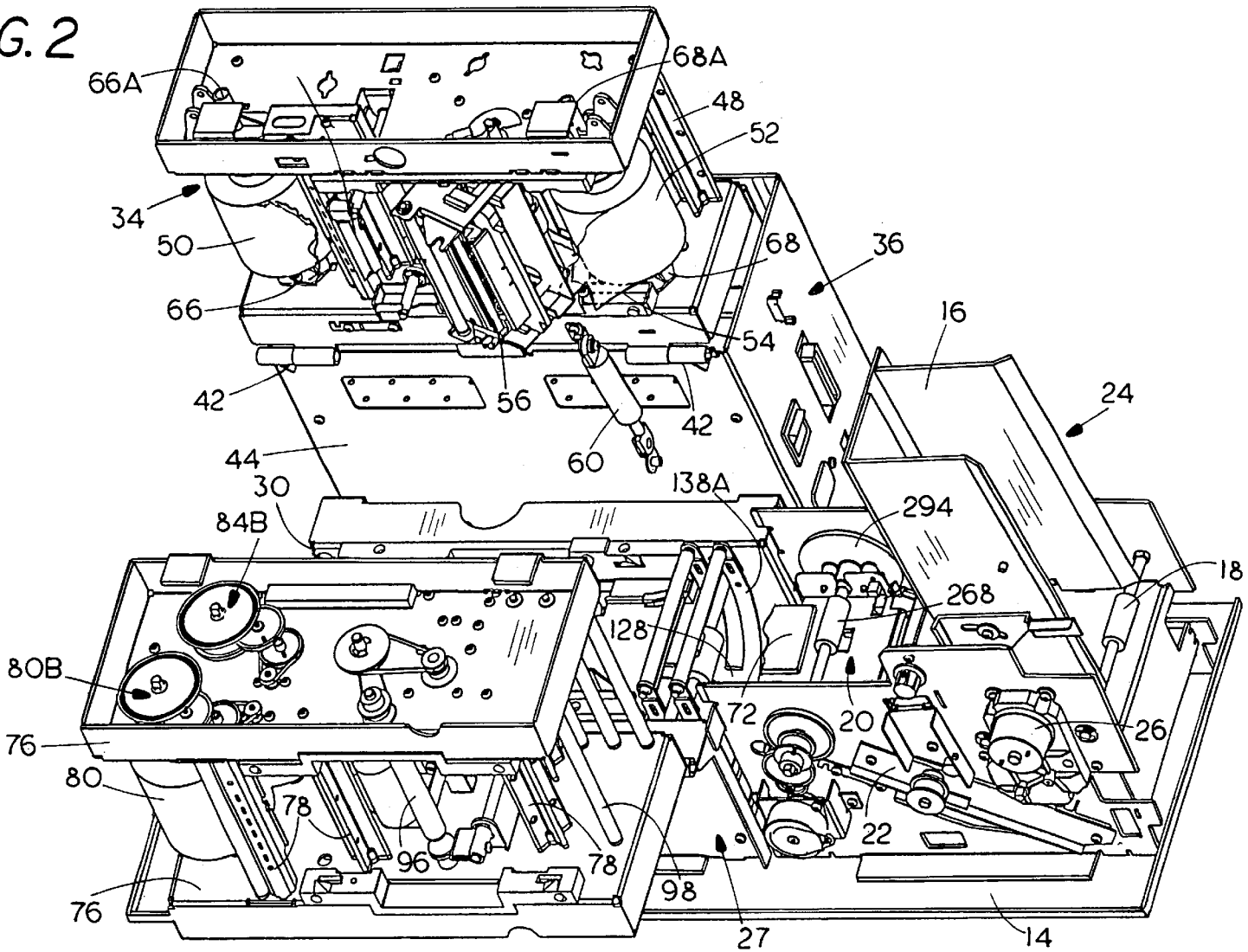
FIG. 2 is a perspective view with two modules of the printer hinged out from a base of the printer to illustrate the typical arrangement for making the film or web supply and take-up rolls accessible to permit easy installation as well as servicing.

It can be seen in FIG. 2, for example, that the supply print film or web coming from the supply roll 50, and taken up by a take-up roller 52, comes off the bottom of the supply roll after the supply roll is snapped into place on its supports 66A at the other end, which will retract to permit inserting the hub onto the end of the supply roll 50, the print film or web is passed over the printhead 56 and then the take-up roll 52 can be moved into place on its supports 68 for the drive end, and a spring loaded pin or hub 68A on the opposite end, which is retracted for inserting the take-up roll 52 without moving any fixed brackets or guides. The film or web does not have to be threaded through openings but can be laid in place as the rolls 50 and 52 are moved into place. The rolls will engage their respective drives when installed.

A color print film or web sensor array illustrated at 70 adjacent to the supply roll 50 is also used for sensing the film or web position, and provide a signal indicating the color that is going to be fed to the printhead by sensing indicia on the film or web, so that the controller 58 can properly control the print film or web position. The correct color image then is printed onto the intermediate transfer film or web.

Intermediate Transfer Film or Web Module

The module 32, as stated, mounts an intermediate transfer film or web 82 that, as shown, will have a reverse image from that which is to be put onto an identification card printed on a coating on one side of the film or web. Direct printing on the intermediate transfer film or web is also contemplated. The identification card on which the image is transferred is shown schematically at 72 in FIG. 5 and also shown in FIG. 2, as it is leaving the indexing table 20 of the card feeder module 24. The card 72 onto which the image is transferred after leaving the card feeder will be supported and driven by conventional drive rollers to the lamination station 40.

The intermediate transfer roller module 32 includes a pair of frame side walls 76 held together with cross members 77 in suitable locations, to form a frame. Hinges 78 are provided between one of the side walls 76 and the upright wall 28 of the base module, as shown. These hinges permit the module 32 to be folded outwardly to the position shown in FIGS. 2 and 3 for servicing and replacing the intermediate transfer film or web.

Figure 7:
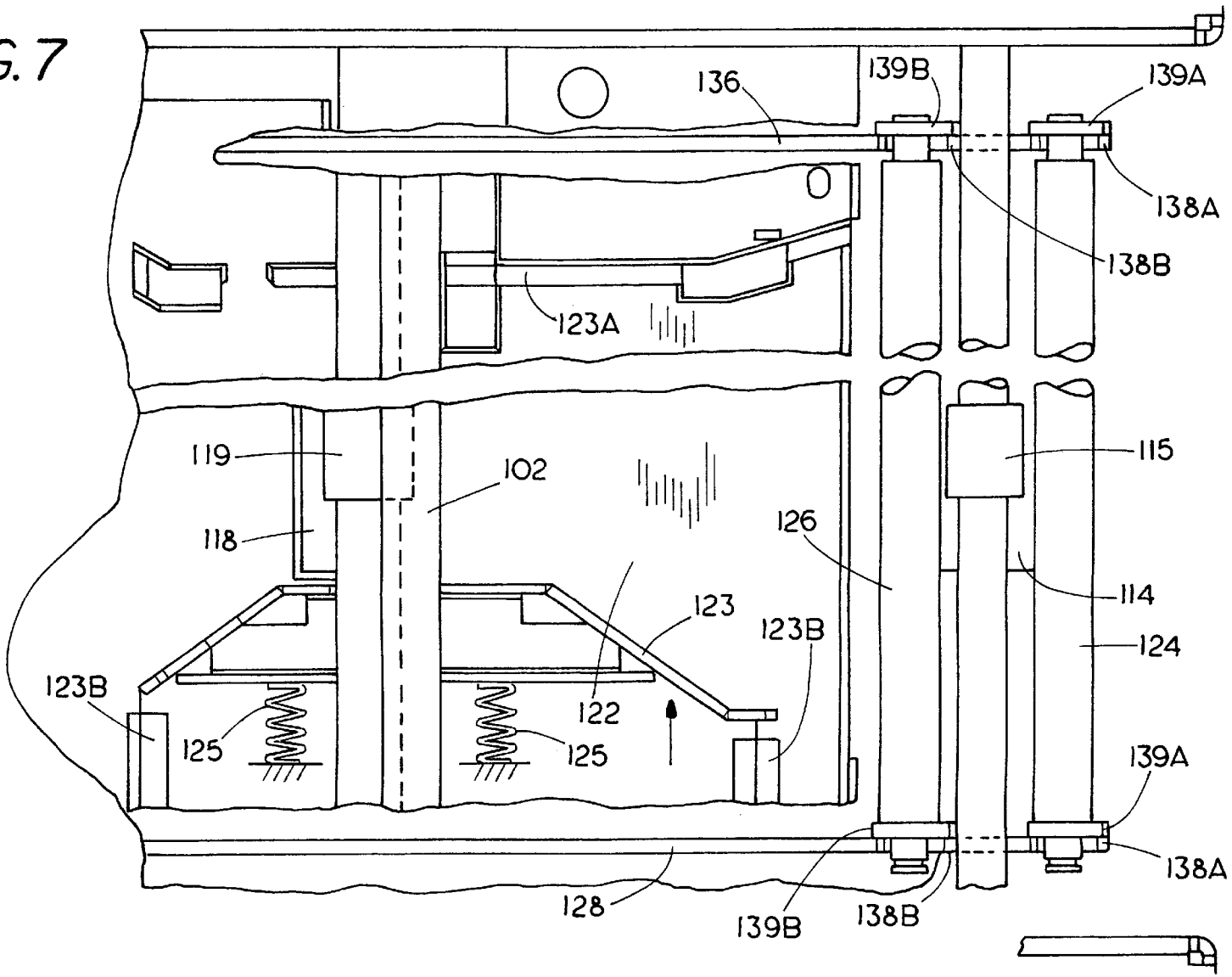
FIG. 7 is an enlarged fragmentary top view of a dancer or take-up roll and support arms used with the present invention.
Figure 8:
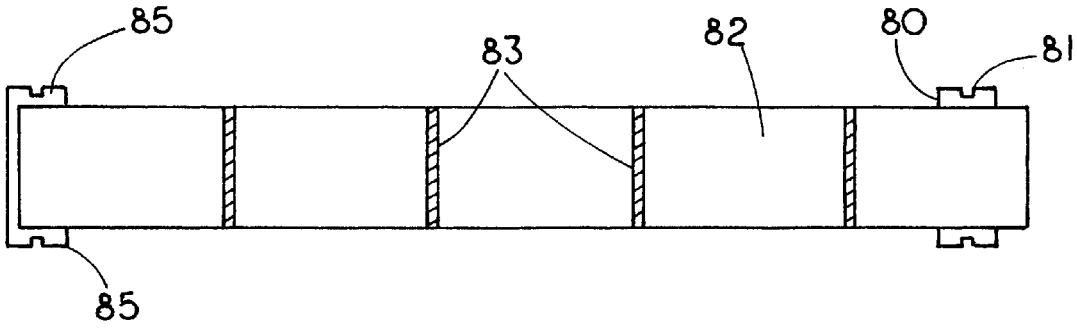
FIG. 8 is a fragmentary schematic flat layout of an intermediate transfer film or web used with the present invention.

The module 32 carries an intermediate transfer film or web supply roll 80 which feeds an intermediate transfer film or web 82 to a take-up roller 84. The supply roll and take-up roll come with the film or web connected to the take-up roll. This arrangement is shown in FIGS. 7 and 8 for illustration. The print film or web also is provided with supply and take-up rolls with the print film or web extending between them similarly to the FIG. 8 shown. The intermediate transfer film or web 82 can be placed across guides, as will be shown in FIG. 5, and through lamination station 40. Additionally, as will be more fully explained, the film or web 82 will pass over spring loaded "dancer" rollers or movable slack take-up rollers that operate in conjunction with fixed rollers to form loops of film or web slack under spring load which permits intermediate transfer film or web slack to be taken up between the lamination station 40 and the thermal printhead 56.

The intermediate transfer film or web, and the supply and take-up rolls or cores 80 and 84 for that film or web can be installed when the module 32 is pivoted to its position shown in FIG. 3 without removing any parts or threading the film or web through openings. The supply roll 80 for the intermediate transfer film or web is mounted onto a known spring spool support 86 at the drive end and a spring loaded retractable pin 86A at the other end. The hub 81 can be driven with the cross slots shown in FIGS. 7 and 8. The take-up roll 84 is mounted on a similar support 87 at the drive end and a spring loaded retractable pin 87A at the opposite end. The take-up roll 84 extends between the side walls 76 of the module 32 and the hub 85 can be driven with a pin and cross slot drive shown. The supply roll 80 is driven with motor 80A (FIG. 5) acting through a belt and gear drive 80B (FIG. 2). The take-up roll is driven by a motor 84A, acting through a belt and gear drive 84B (FIG. 2).

Figure 5:
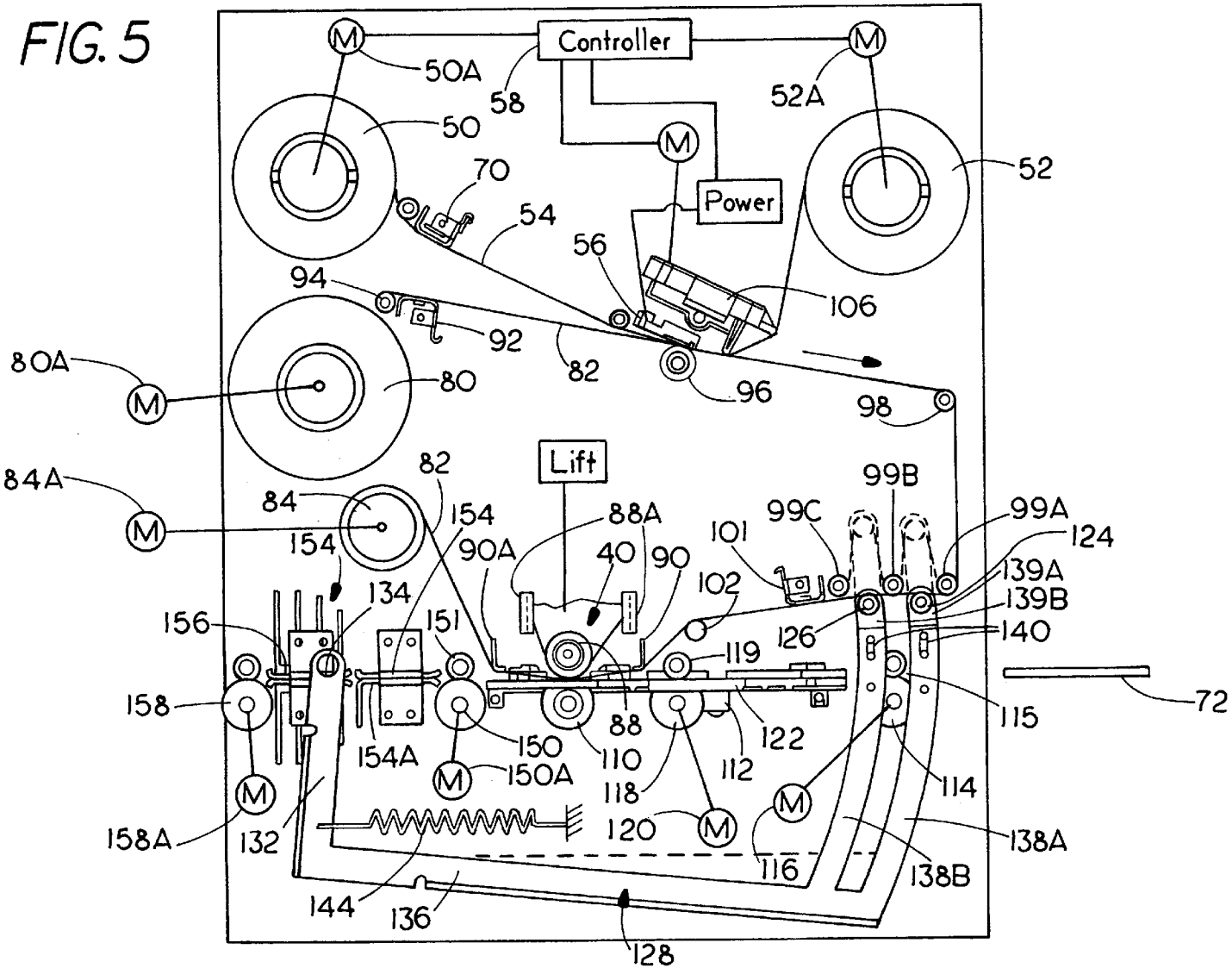
FIG. 5 is a part schematic representation of the paths of the film or web and a "dancer" take-up roll that permits the intermediate transfer film or web to move back and forth in opposite directions for printing while being held stationary at a lamination station.

A guide roller 94 is also provided on the output side of the intermediate transfer film or web supply roll 80 (FIG. 5).

Figure 4:
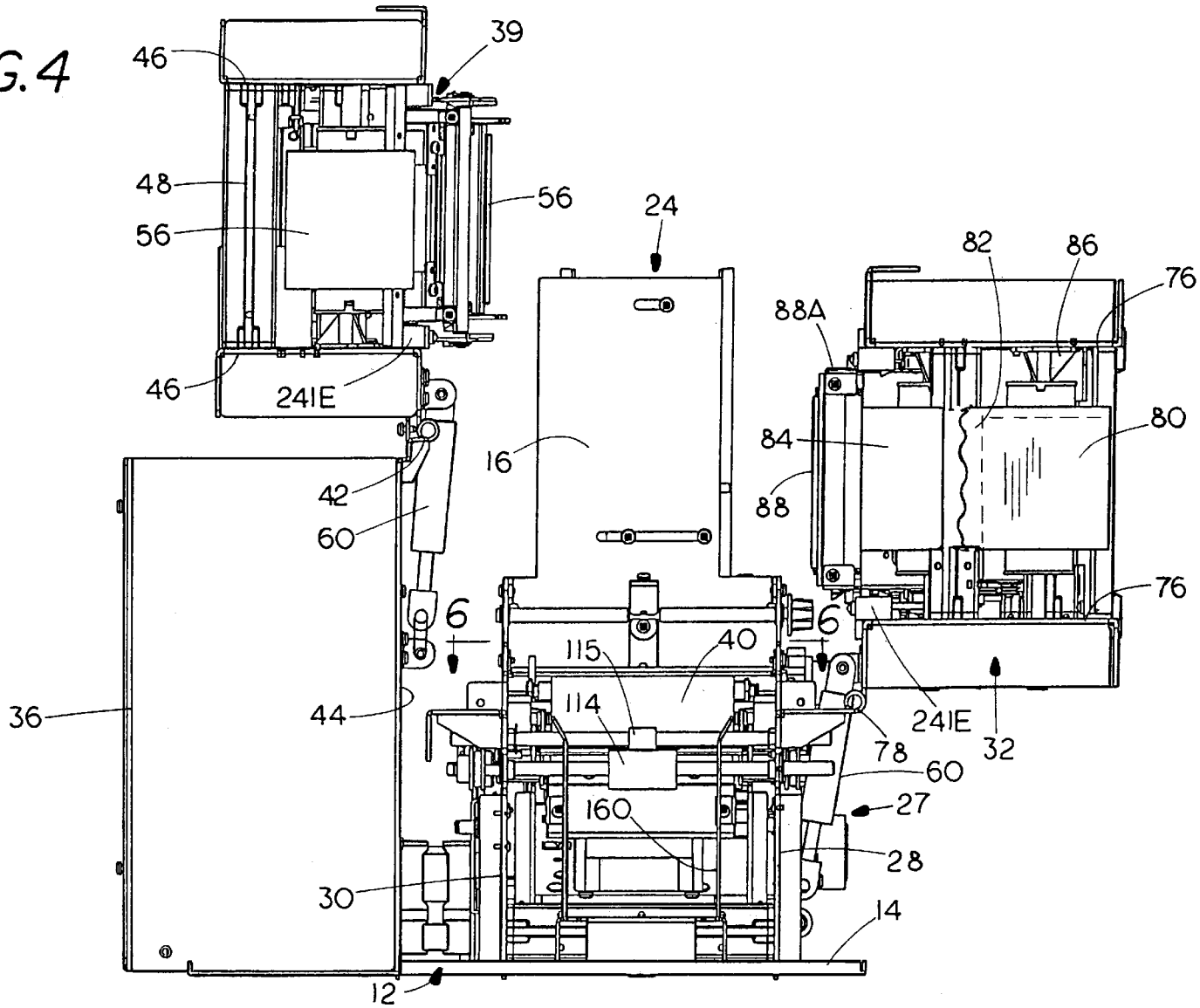
FIG. 4 is an end view showing the modules in their open positions of FIGS. 2 and 3.

The lamination station 40 includes a heated roller 88 for laminating or transferring the printed image from the intermediate transfer film or web 82 to the card 72 as shown in FIGS. 3, 4 and 5. The lamination station 40 carrying is mounted on suitable slider supports 88A to the side walls 76, and is carried with the module 32. The heated roll is moved toward and away from a backing roll or platen to accommodate card thickness and to relieve pressure on the intermediate transfer film or web. The lamination roll can be spring loaded toward the platen. Thus, the hot roller shown in FIG. 4 at 88 is moved with the module 32 to pivot away from the base module. A cross member or supports 90 forms a guide bar on the input side to the laminating roller 88 and cross member 90A forms the guide on the output side of the laminating roller (FIG. 5). The heated roller 88 can be covered with clamshell doors when the modules open to cover the hot surface so it is not accidentally touched.

The position of images on intermediate transfer film or web 82 is directly sensed with suitable sensors, such as a sensor shown at 92 in FIG. 5 that is mounted between the side walls of the module, and moves with the module. The intermediate transfer film or web 82 does not need, but can have index marks or other indicators 83 placed on the film or web (FIG. 8) to identify positions where the image to be printed should start. In FIG. 8, the marks shown as strips 83 of white or reflective material at the start of each image panel or section are to indicate the position for the reverse image to be transferred to a card 72. The same marks can be used on the print film or web.

In FIGS. 2 and 5, it can be seen that a printer head platen roller 96 is rotatably mounted between side walls 76, 76 of the module 32. The printer platen roller 96 is mounted on the module 32, so that it is shown in FIG. 2 with the module open.

Figure 6:
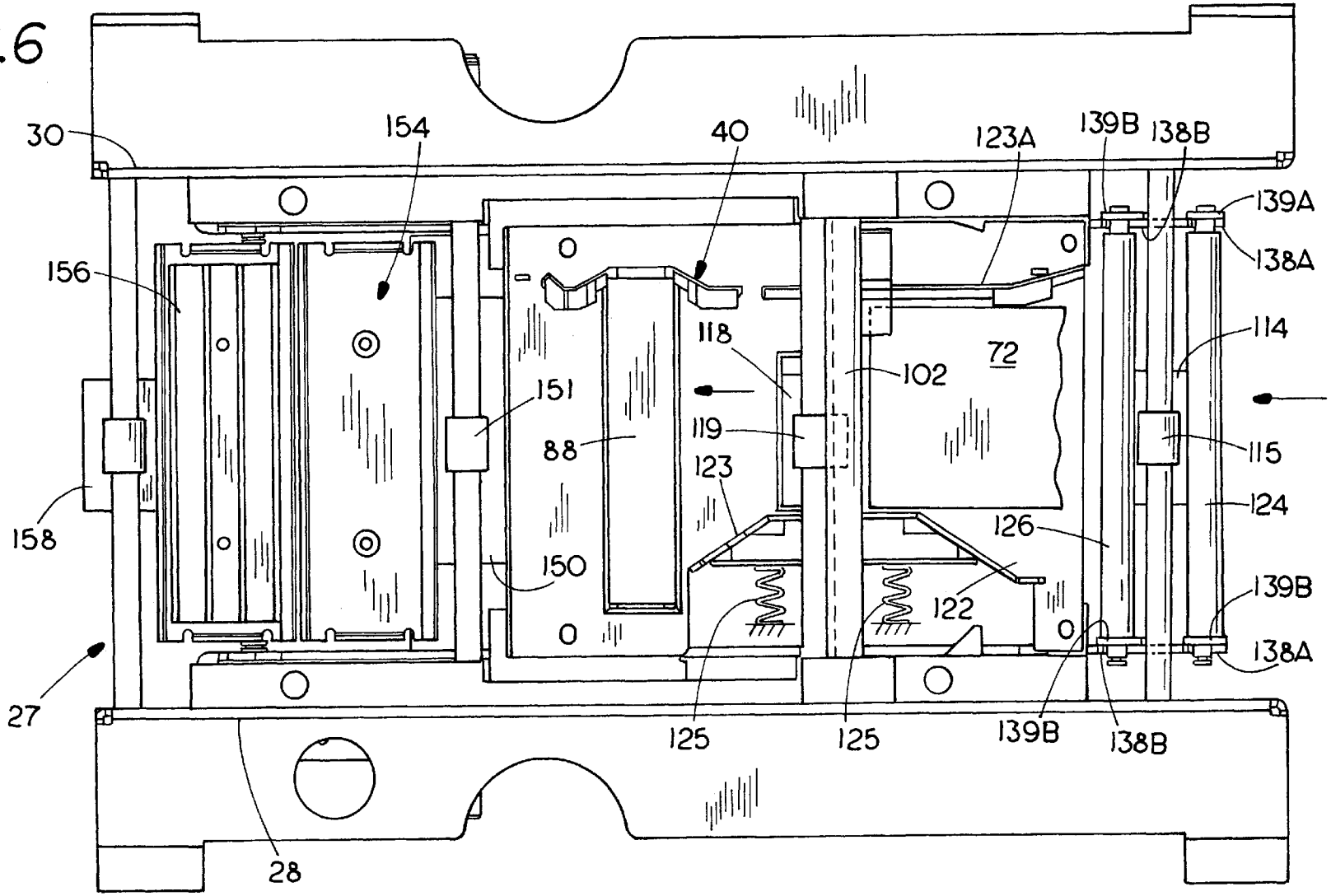
FIG. 6 is a top plan view of a lower portion of the printer of the present invention taken generally along line 6—6 in FIG. 4.

All of the guide and operational rollers around which the intermediate transfer film or web 82 needs to be placed, are carried in the module 32 between the side walls 76, 76. This includes a first guide roller 98 that is positioned to be on the output side of the printhead and a series of three guide rollers 99A, 99B and 99C that are positioned near the top of the lower base module, and are spaced apart a selected distance to provide clearance for interdigitated take-up rollers 124 and 126 that are on spring loaded dancer arms 128 and 130 (See FIGS. 5, 6 and 7). A suitable sensor 101 is mounted between the guide roller 99C and a further guide roller 102 for the intermediate transfer film or web 82. The sensor 101 is also used to detect the leading edge of the images on the intermediate transfer film or web 82 for determining the position of the printed image that has been printed on the intermediate transfer film or web. This indicates when the image that has been printed is in proper position to enter into the lamination station 40, and the position of the image sensed can be synchronized with the movement of the card 72. The position of a card 72 can be sensed with a sensor 112 that senses a leading edge of a card. The synchronization is carried out with the controller 58.

The rollers 98, 99A, 99B and 99C are rotatably mounted on walls 76 of module 32, and do not otherwise move. The guide roller 102 and the take-up rollers 124 and 126 are mounted onto the spring loaded dancer arms 128 and 130 contained within the base module 36 between the side walls 28 and 30.

Thus, the intermediate transfer film or web 82 comes off the supply roll 80 over the film or web sensor 92, on the outside of the platen roller 96, and passes on the outside of (over) idler roller 98, which will be exposed when the module 32 is in the position as shown in FIGS. 2 and 4, and then the film or web passes around the rollers 99A, 99B and 99C and under the sensor 101, which again is to the exterior (facing the module 34).

Figure 9:
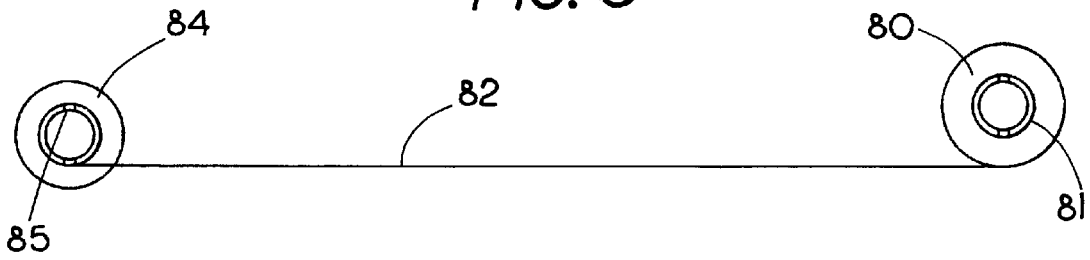
FIG. 9 is a side view of supply and take-up rollers for the film or web of FIG. 8 with a length of film or web between the rolls.

The intermediate transfer film or web 82 will be below rollers 99A, 99B and 99C when the module 32 is pivoted closed, as shown in FIG. 5. The intermediate transfer film or web is passed around the guide bars 90 and 90A and the laminating roller 88, and then the take-up roll 84 is mounted on its supports. The intermediate transfer film or web 82 is installed by having the supply and take-up rolls out of the module as shown in FIG. 9, and unrolling enough film or web so that the film or web can be placed over the rollers, sensors and guides just described. Then the supply roll 80 is installed on its supports. The take-up roll is manipulated so the loose film or web is placed over the film or web guides and around the laminating roll 88, and then the take-up roll 84 is put into place. Since the guide 102 and rollers 124 and 126 are on the base module when the modules are closed to their positions shown in FIG. 1, the intermediate transfer film or web will be properly supported on the top of the guides and slack take-up rollers.

Intermediate Transfer Film or Web Slack and Movable "Dancer" Rollers

Perhaps as best seen in FIG. 5 in the schematic showing, the controller 58 controls the print film or web supply roll 50 and the print film or web take-up roll 52 through their respective motors 50A and 52A. In addition, the controller 58 controls the motors 80A and 84A that are used with the intermediate transfer film or web supply roll 80 and take-up roll 84, respectively. Thus, operation of the print film or web and intermediate transfer film or web is coordinated. The controller also controls power to the printhead 56 and other components used in the printing process.

In FIG. 5, there is a print film or web guide assembly 106 illustrated for guiding the colored print film or web 54 past the printhead 56, and it can be mounted in a suitable manner between the side plates of the module 34.

When the two modules 32 and 34 are pivoted to working position, the printer platen 96 clamps the printable surface of the intermediate transfer film or web 82 formed by a suitable print receptive and transferrable coating up against the print film or web 54 under the printhead 56, so that images can be printed by the printhead 56, acting on the color print film or web 54, onto the intermediate transfer film or web 82. As shown, a reverse image will be printed from that which is desired to be put on the identification card 72.

In doing the printing, the film or web 54, either resin or thermal dye sublimation, which carries the colors that are to be used for printing an image onto the intermediate transfer film or web, will be moved back and forth so that individual color panels on the film or web (yellow, magenta, cyan, clear or black) and will be moved along under the printhead. The individual color panels that make up the multi-colored image will be printed sequential. That requires moving the print film or web 54 forwardly and backwardly, in a number of passes to complete the printing process, and that also means that the intermediate transfer film or web 82 has to be moved forwardly and backwardly the same number of times and distances for proper registration of the images.

When the reverse image from the intermediate transfer film or web 82 is being laminated onto a card 72 in the lamination station 40, it is held securely between the heated laminated roller 82 and the pinch roller or backing roller 110 forming part of the lamination station 40. The lamination station 40 is also controlled by the controller 58, so that it is known when the lamination is taking place. Lamination is done by coordinating the print image position sensed by the sensor 102, and the card whose position is sensed, with a suitable card position sensor 112.

The card 72 is fed with card feed rollers 114 and 118, which have pinch rollers 115 and 119 on top of them. Roller 114 is powered with a suitable motor 116 controlled from the controller 58, and card feed roller 118 is powered by a motor 120. The pinch rollers 115 and 119 on the top of the drive rollers 114 and 118 insure that a card 72 will be positively fed onto a card path guide table 122 (FIGS. 6 and 7) which supports the card as it is moved into the lamination station 40 and has side guides 123 and 123A.

The side guide 123 is slidably mounted on the horizontal table 122 using guides 123B and is spring loaded with springs 125 (shown schematically) to permit automatic adjustments for card widths. The adjustments can accommodate cards 2⅛ to 2⅝ inches automatically. Cards down to 1 inch side can be accommodated with manual settings on the spring adjustment. The card support 122 can be a table as shown, or other suitable support.

The card 72 will be moved in the lamination station 40 as desired as well. The lamination does not take as long as the printing because it only requires one pass under the laminator as compared to several passes under the printhead. The intermediate transfer film or web 82 is not moved back and forth under the lamination roller 88, but yet the section of the intermediate transfer film or web 82 between the lamination roller 88 and the printhead 56 has to be moved back and forth under the printing head 56. The supply roll 80 can be reversed by motor 80A when the film or web 82 is reversed in the printhead, but the film or web 82 is relatively stationary in the lamination station.

In order to accommodate the printing movement, the intermediate transfer film or web 82 has to have some slack between the printhead 56 and lamination station, and the slack amount changes as the film or web 82 moves back and forth under the printhead. This slack is taken up with "dancer" rollers or slack take-up rollers which are shown at 124 and 126. The slack take-up rollers are movable and positioned so that they will pass through the space between the fixed position guide rollers 99A and 99B, and 99B and 99C, respectively. The dancer or slack take-up rollers 124 and 126 are mounted onto side guide arms 128 and 130 (see FIGS. 5, 6 and 7). The arms 128 and 130 both have support legs 132 that are pivotally mounted on suitable pivots 134, and then main arm portions 136 that extend along the side plates 28 and 30 from the pivot 134, which is near the output side of the lamination station 40. The arms 136 each support a pair of fingers 138A and 138B. The upper ends of the fingers 138A and 138B adjustably mount strap-like brackets 139A and 139B which rotatably mount the dancer or slack take-up rollers 124 and 126. The strap-like brackets 139A and 139B are adjustable along slots 140 in each of the fingers 138A and 138B, using suitable cap screw or fasteners that will adjust the strap-like brackets on which the rollers are mounted.

Movement of the Slack Take-up Rollers

A spring 144 is connected to at least of the legs 132 on each side of the module 36. The springs provide a biasing force tending to move the fingers 138A and 138B, and thus the take-up rollers 124 and 126, upwardly. Since the rollers 124 and 126 are below the intermediate transfer film or web 82, and rollers 99A, B and C are above it, they will only be permitted to move upward under the pressure from spring 144 when the film or web 82 has slack between the printhead 56 and the laminating head 40. However, when this occurs, the arms 128 and 130 will pivot up under the spring load and the rollers 124 and 126 will guide the intermediate transfer film or web upwardly as shown in dotted lines in FIG. 5 to take up the slack that is necessary for moving the intermediate transfer film or web back and forth during the printing operation. This take-up is automatic, and the spring 144 is selected in load so that it will keep a tension load on the intermediate transfer film or web without unduly stressing the film or web.

Once the lamination has been completed at the lamination station 40, the cards 72 containing the printed images are fed into a drive roller 150, which has a pinch roller 151 at the top and is driven with a motor 150A. The cards are also fed into a card straightener assembly or card flattener that is indicated at 154 and is used for removing any curl from the card that occurred. The lamination temperature used is in the range of 360° to 380° F., so the cards will soften. The card straightener has a spring loaded heated plate at the top (see FIG. 10) and a lower support plate 154A below it so the heated card, which becomes flexible when laminated can rest on flat lower plate 154A (FIG. 5) to become flat. Cooling plates 156 are also provided for receiving the card to hold it flat and to provide for cooling after passing through the heating plates 154 of the card straightener. The cooling plates have fins for cooling. A card drive roller 158 is driven by the motor 158A to move the card out of the printer and laminator assembly into a finished card hopper 160 shown in FIGS. 1 and 3 for example.

The card straightener 154 with the cooling plates 156 is optional for use with the printer. The heater plates 154 are flat, they keep the card flat as it softens and is cooled. Then the cooling plates 156 will cool the card so that it will not recur before it is discharged into the discharge hopper 160.

Figure 5A:
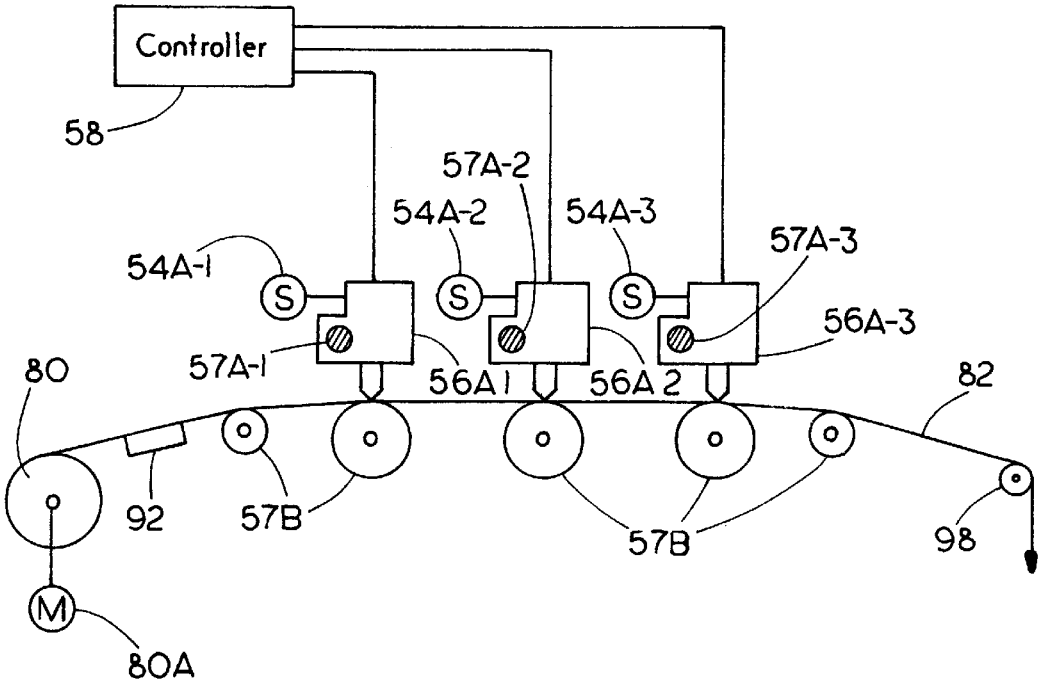
FIG. 5A is a view similar to the upper portion of FIG. 5 showing three ink jet printers to apply three individual colors to the intermediate transfer film or web in use.

Other types of printers can be used besides the single thermal printer shown in FIG. 5, and in FIG. 5A, there is illustrated the same construction as discussed in relation to FIG. 5, in so far as the printer and intermediate transfer rolls are concerned, but as shown, instead of a thermal dye sublimation printer, three ink jet printers 56A-1, 56A-2 and 56A-3 are utilized, with an ink jet supply, and each with a cross support rod 57A-1, 57A-2 and 57A-3, respectively, for holding the ink jet printheads for individual lateral travel across the intermediate transfer film or web 82, respectively, if needed, to print across the full width of the intermediate transfer film or web.

The individual ink jet printheads 56A-1, 56A-2 and 56A-3 are provided with separate different monochromatic color ink sources (yellow, magenta, and cyan). If four or more colors are used, four or more ink jet printheads are used, one for each color. The color ink supplies are shown 54A-1, 54A-2, and 54A-3. The ink jet printing on the intermediate transfer film or web is carried out under control of the controller 58. The supply 54A-3 can be a protective ink fixing agent for the last head in sequent, as shown in head 56A-3. Also, one ink print jet head can be provided with a multiple color ink supply to accommodate multiple color printing with one printhead.

There is no need for a print film or web in the form of the invention that uses an ink jet printer. Use of an ink jet printer for printing on identification cards is described in more detail in U.S. patent application Ser. No. 09/178,455 filed Oct. 23, 1998, entitled "Ink Jet Identification Card Printer With Lamination System", which is incorporated herein by reference.

The intermediate transfer film or web 82 is mounted on suitable supports shown at 57B, that are located in proper position so that the ink jet print head 56A-1 will be printing on a flat surface of the transfer surface side of the intermediate transfer film or web.

The rest of the process for transferring an image to a substrate of card will be the same, once the image has been printed on the intermediate transfer film or web with the ink jet printers, and the film or web 82 will be fed to the roller 98, and then the rollers 99 and following as previously described.

Alternatively, controller 58 will be modified to provide power and control to the ink jet printers in a conventional manner, and the ink jet printers will travel laterally across the intermediate transfer film or web along the rods 57A-1, 57A-2 and 57A-3, as is done with ink jet printer heads.

Figure 5B:
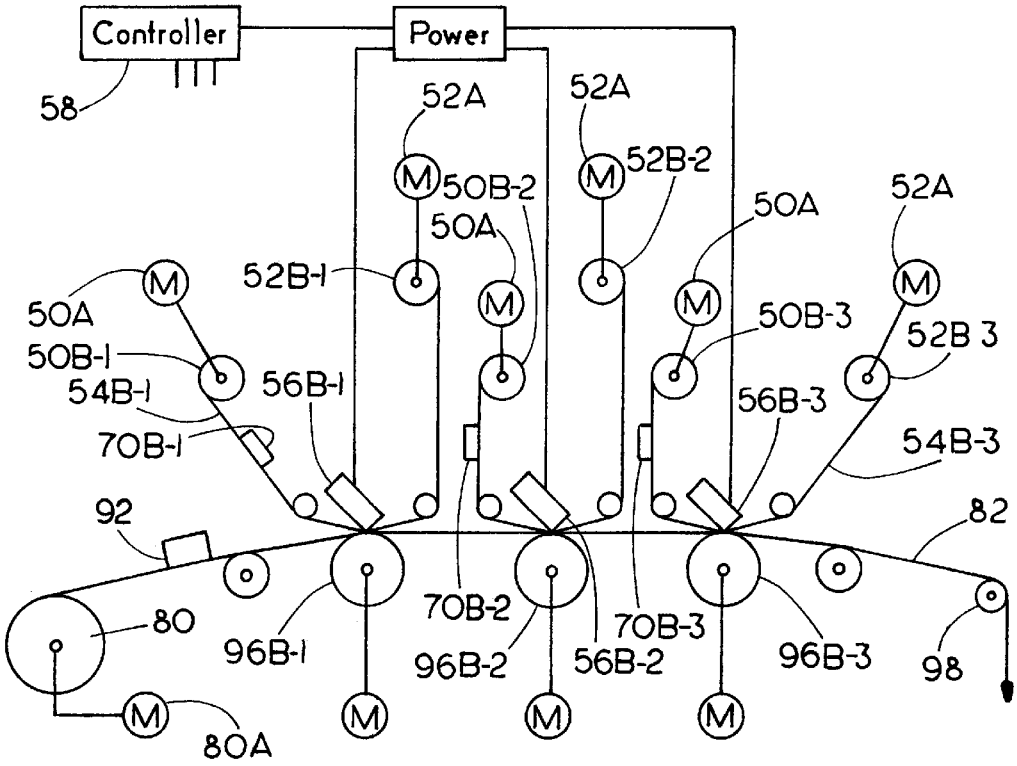
FIG. 5B is a view similar to FIG. 5A showing three thermal printheads for printing three colors from separate monochromatic print films or webs in sequence.

In FIG. 5B, a modified thermal dye sublimation printer arrangement is set up, using one thermal printhead for each of the colors used. In FIG. 5B there are three printheads 56B-1, 56B-2 and 56B-3 in series one after the other in the path of travel of the intermediate transfer film or web. The three printheads are controlled individually from the controller 58 as previously described in relation to a single thermal printhead, and these printheads 56B-1, 56B-2 and 56B-3 are associated with a film or web of one color (monochromatic ribbon). The printheads are operated so that each one will print a particular separate color (yellow, magenta and cyan) from a thermally activated film or web 54B-1, 54B-2 and 54B-3, respectively. Suitable guide rollers and platen rollers 96B-1, 96B-2, and 96B-3 are provided to guide the films or webs containing the respective colors underneath the respective printheads. Individual drive motors are provided for the supply rolls 50B-1, 50B-2, and 50B-3 and take-up rolls 52B-1, 52B-2 and 52B-3 will be operated to move the respective film or web at a desired interval for individually printing each of the colors on a single image panel on the intermediate transfer film or web. The printheads are shown close together, but they can be spaced as desired so that the spacing between each of them is equal to one panel length, but the illustrative showing in FIG. 5B is for illustrative purposes, and is not to scale.

The platen rollers 96B-1, 96B-2 and 96B-3 are provided under each of the respective printheads 56B-1, 56B-2 and 56B-3 so that the dye sublimation printing can proceed. Sensors 70B-1, 70B-2 and 70B-3 are used for each print film or web used and can be the same as that shown in FIG. 5. The take-up for the intermediate transfer film or web 82 is the same as shown in FIG. 5, and the same lamination station is used.

Each of the individual dye sublimation printheads have a separate head lift so the printheads can be lifted up when the film or web is made to move back and forth in the printing process.

Figure 10:
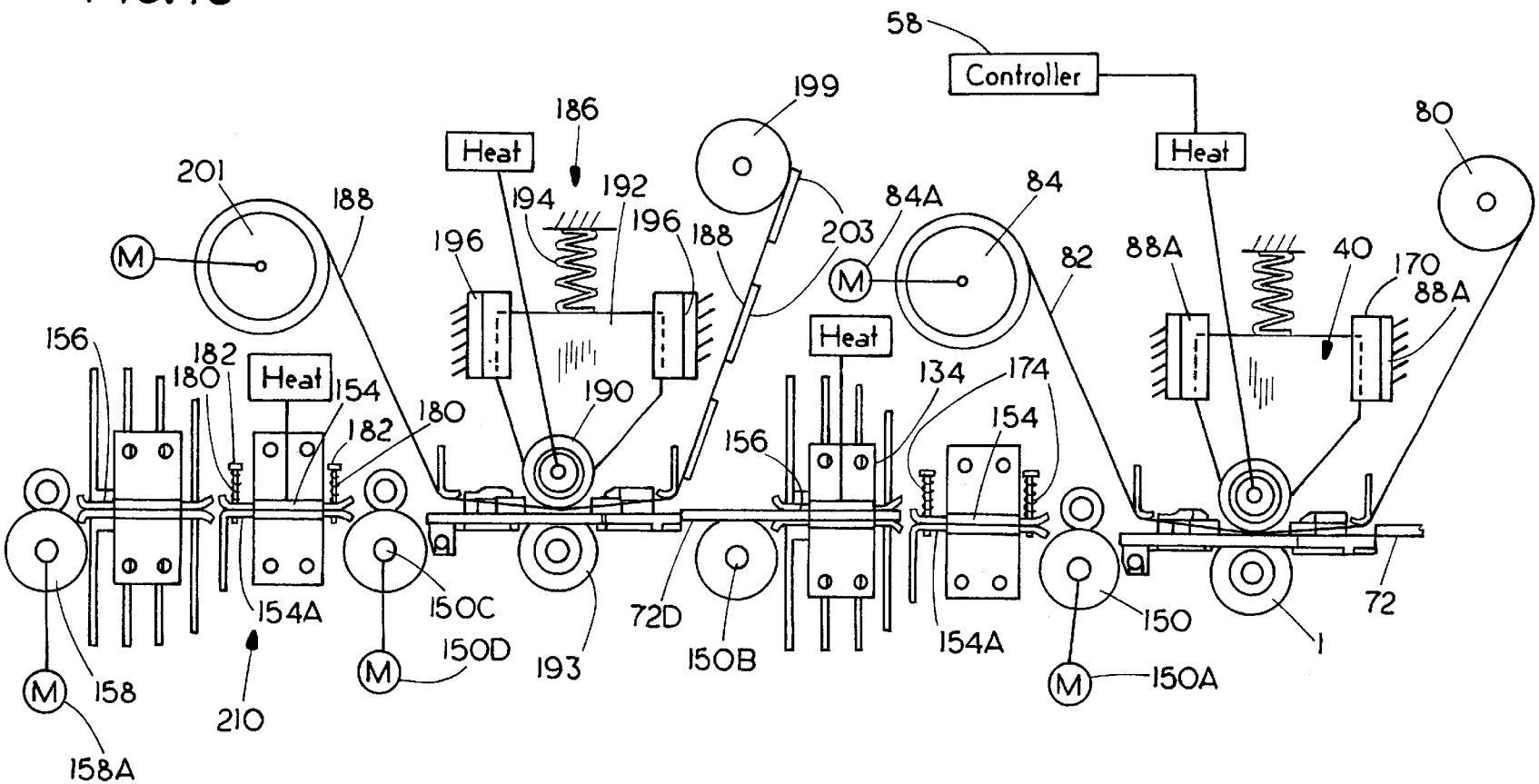
FIG. 10 is a schematic view of use of a laminator for laminating a protective layer on a card.

In FIG. 10, a schematic representation of a second lamination station for placing on a protective overlay film onto a card that carries a chip as illustrated.

As shown in FIG. 10, the first lamination station 40 is illustrated schematically, it can be seen that it can be moved up and down suitable guides indicated again schematically at 170, and the lower roller 110, as shown as fixed relative to the printer frame. The intermediate transfer ribbon 82 is illustrated between supply roller 80 and take-up roller 84. A card 72 is in position to enter the lamination station 40, and the lamination station 40, which includes a heat source 172 for heating the roll 88 is illustrated. This would be controlled so that it provides power to the heater from the controller 58. The card straightener station having the plates 154 and 154A for providing heat to soften the card as previously explained is shown. In FIG. 10, it is illustrated that the plate 154 is spring loaded relative to the plate 154A which is fixed on the frame. Springs shown at 174 are provided on pins 176 on which the upper plate 154 slides.

This is the same as shown in the first form of the invention, and the card that has the image from the intermediate transfer ribbon or web thereon is passed into the card straightener 156 again. The card straightener has spring-loaded plates shown schematically in FIG. 10 with illustrating springs 180 on pins 182 on which an upper plate will slide.

A second lamination station shown at 186 is then provided for placing a clear overlaid film layer section 203 onto the card that has been processed, and carries the printed image and a chip to be protected, for example. The lamination station 186 has a heated lamination roller 190 mounted on a sliding support 192 that is spring loaded with a spring 194, as is the lamination station 40, as shown in FIG. 10. Suitable supports 196 slidably guide the roller support 192 toward and away from a fixed backing roller 192 that is mounted relative to the frame. The overlay protective film layers 203 are on a web 188 that is provided from a suitable supply roll 199 and taken up by a driven roller 201, so that the film layer passes underneath the lamination roller 190 and above the backing roller 193 so that as a printed card 72D enters these rollers and the film 188 is passed over the rollers, and the individual sections of clear laminate 203 carried thereon at spaced locations is laminated to the card. The position of section 203 can be indexed relative to the card by suitable sensors as shown in U.S. Pat. No. 5,807,461. optionally, once the clear plastic overlay section has been laminated onto the card 72D, it is passed through a second card straightener 210, that is made up in the same manner as the card straightener having the plates 154 and 154A, and from that card straightener station, the card will pass into a cooling section utilizing the cooling plates 156 as illustrated. As will be disclosed, a card flipper or inverter can be added and the second side of the card can be printed.

In the form of FIG. 10, there are two lamination stations in series, and the card straightener and cooling sections that are shown in FIG. 10 between the lamination station 40 in the lamination station 186 can be eliminated, so that as soon as the card has received its printed image from the intermediate transfer 82, it can be passed into the second lamination station for receiving the clear plastic overlay sections 203. This is shown schematically, because the overlay lamination is well known, and is disclosed in U.S. Pat. No. 5,807,461. The drive rollers for the card in FIG. 10 are illustrated and merely numbered on rollers 150, 150B and 150C. Motors shown are 150A and 150D.

Figure 11:
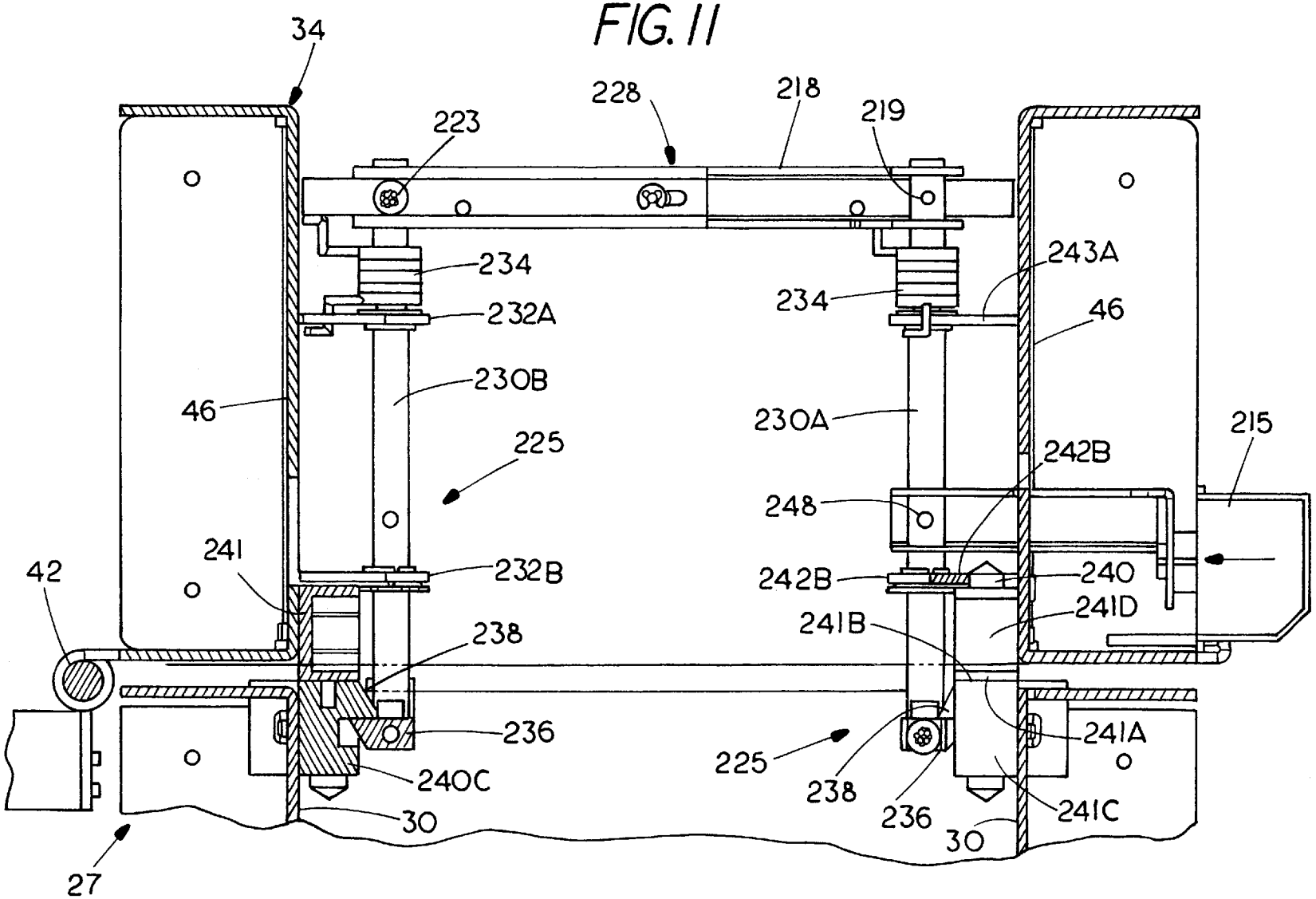
FIG. 11 is a fragmentary end view of the base and intermediate module viewed from a card feeder end illustrating a tapered latch for the modules.

In FIGS. 11, 12, 13 and 14 a latch construction is illustrated for alignment and latching of the printer modules. FIG. 11, on the left side, shows a sectional view of the latches and the right side shows a side view thereof and looking from the output end toward the card input hopper, and shows the module 34 with the side walls 46, 46 illustrated. The latches engage with parts on the base module 27 and the hinges 42, which hinge module 36 to the circuit card module.

Latches indicated generally at 225 are on opposite sides of the module, adjacent each of the side walls 40 engaging latch lugs on the walls 30 of the base module 27.

A movable push button 215 is mounted on a lever 216 that is mounted on latch shaft 230A with a suitable pin shown at 218.

The latch shaft 230A is rotatably held in suitable brackets, such as bracket 242A and 242B, and an upper portion of the shaft 230A has a link lever 218 attached thereto, and also pinned with a pin 219 to the shaft. The link lever 218 is in turn joined with a link 220 to a second link lever 222 (see FIG. 13) that is drivably connected with a suitable pin 223 (FIG. 11) to a latch shaft 230B on the opposite side of the module 34 from the shaft 230A. The push button 215 does protrude from the side of the module 34, when it is in its position shown in FIG. 11, which is the latched position.

The latches 225 comprise the rotatable or twistable latch shafts 230A and 230B that are mounted in suitable pivot brackets 232A and B and 242A and B to the respective side wall 46. A torsion spring 234 on each of the shafts 230A and 230B that causes a rotational force to a home position where the latches are in the position shown in FIG. 11.

Figure 12:
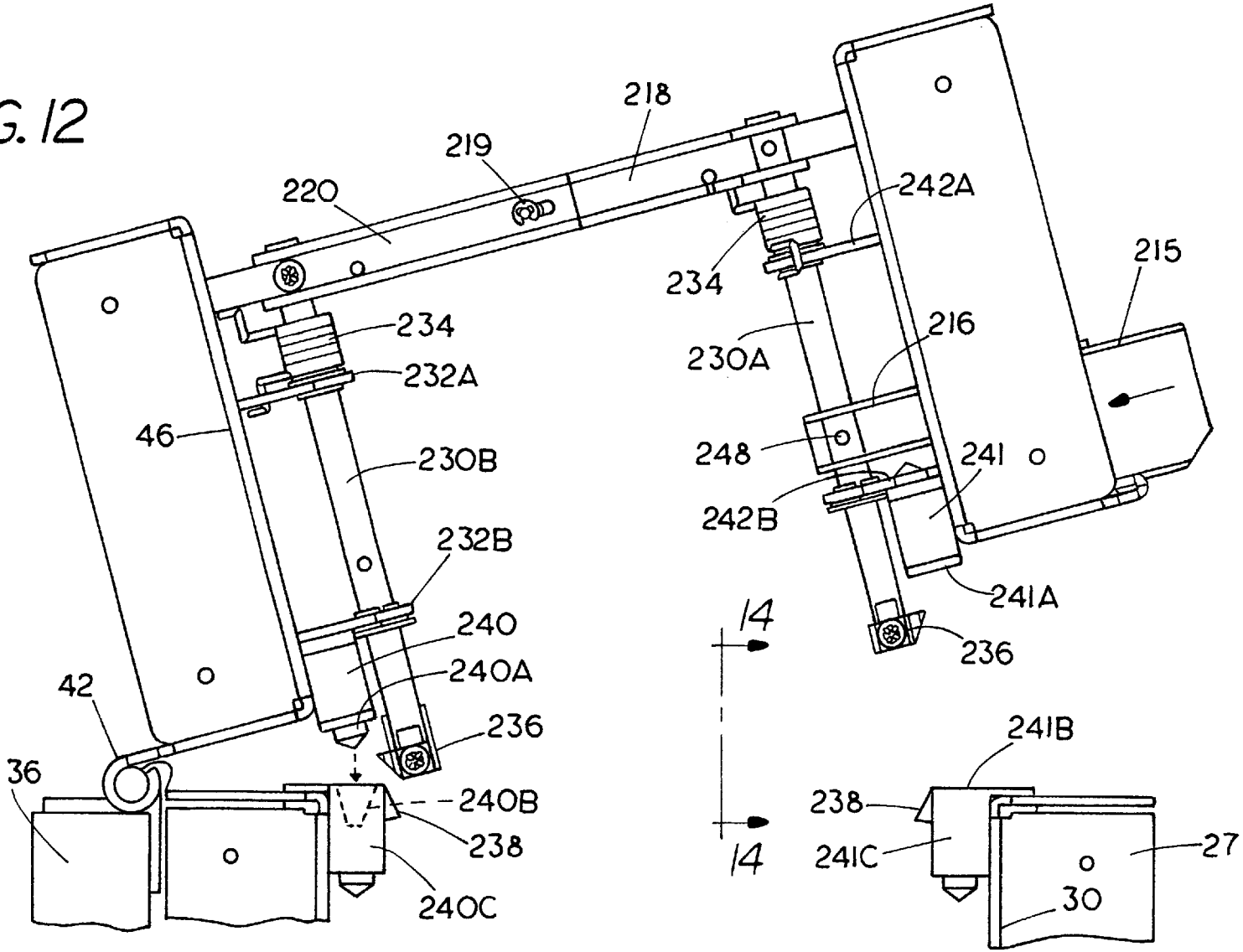
FIG. 12 is a view showing the printer module in a partially opened position showing the latches.
Figure 13:
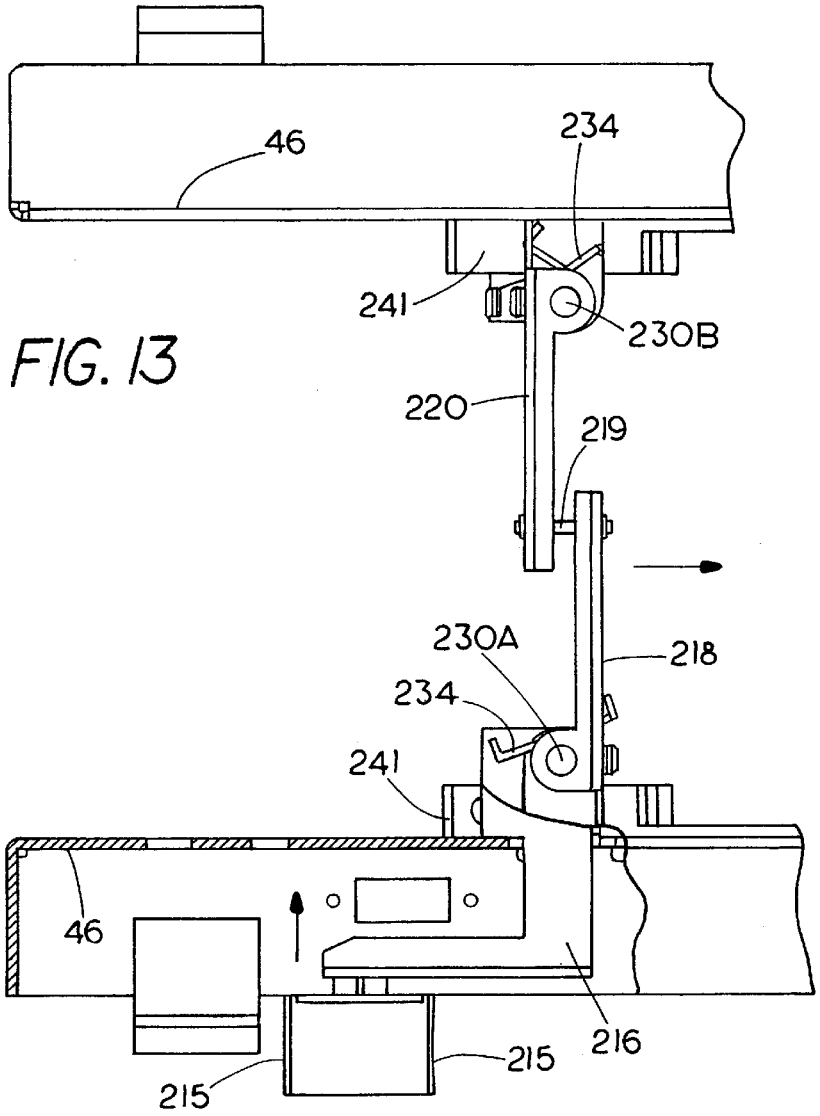
FIG. 13 is a top plan view of the structure shown in FIG. 11.

The push button is manually operable, and when pushed, will rotate both of the shafts 230A and 230B so that latched dogs shown at 236 will rotate out from under the stationary latch lugs 238, and will clear these latch lugs when they are rotated, so that the module 34 can be moved on its hinges 42 to an open position as shown in FIG. 4, for example, and also as shown partially open in FIG. 12.

The latches are made with a guide block 240 on the hinging side of the modules, with a pin member 240A that extends down to be received in a receptacle 240B of a lower inverted guide block (constructed the same way and shown at 240C). On the side of the module that has the push button, the guide block shown at 241 on the module 34 has a base surface 241A that engages a base surface 241B of a similar guide block 241C that mounts on the base module 27. The surfaces are merely for abutment, as the parts come together.

The latch dogs 236 are cams, that will slide along tapered surfaces of the latch members 238 as the parts close, so that the shafts 230 and 230A will pivot or twist about their axes as controlled by the torsion springs 234 to yield for the latching, and then snap into place as they move to their home position. The latch dogs are off-set from the guide pin 240A.

By pushing the single button 215, both of the latches 225 on both sides of the base module will be released, and when the module 34 tends to close, it will be guided properly into position so that the various rolls and guides between the modules that carry the films or webs will be properly aligned.

If desired, guide pins could be placed in the guide block 241 for more positive guiding.

Figure 14:
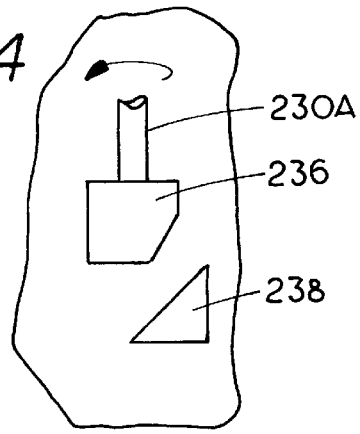
FIG. 14 is a schematic view taken generally along line 14—14 in FIG. 12 as the latches move closer to a latching position.

Either the latch lugs 238, or the latch dogs 236 can be cammed, or both can be cammed or tapered generally, as shown in FIG. 14, so that as the module moves to its closed position, the shafts 230 will rotate out of the way, and then will snap back under the latch lugs 238. The same latch are used between modules 32 and base module 27.

There are instances where the substrate that has to be printed is to be printed on both sides of the substrate, and the previous description has dealt with laminating an image on only one side, and as an alternative, also laminating a clear plastic overlay on the printed image.

In order to print on both sides of the substrate or card, a flipper or inverter table can be used for receiving the card from the lamination station 40, and reinserting the card in the lamination station, and either at the same time or subsequently, moving the intermediate transfer film or web to a position to register the new image from the intermediate transfer film or web over the second side of the substrate or card.

If desired, then, the card can have the clear plastic overlays placed on both sides, by having a subsequent lamination station and inverting the card to place the clear overlays on both sides of the card. Card straightener stations can be put into the sequence, where desired, as well.

Figure 15:
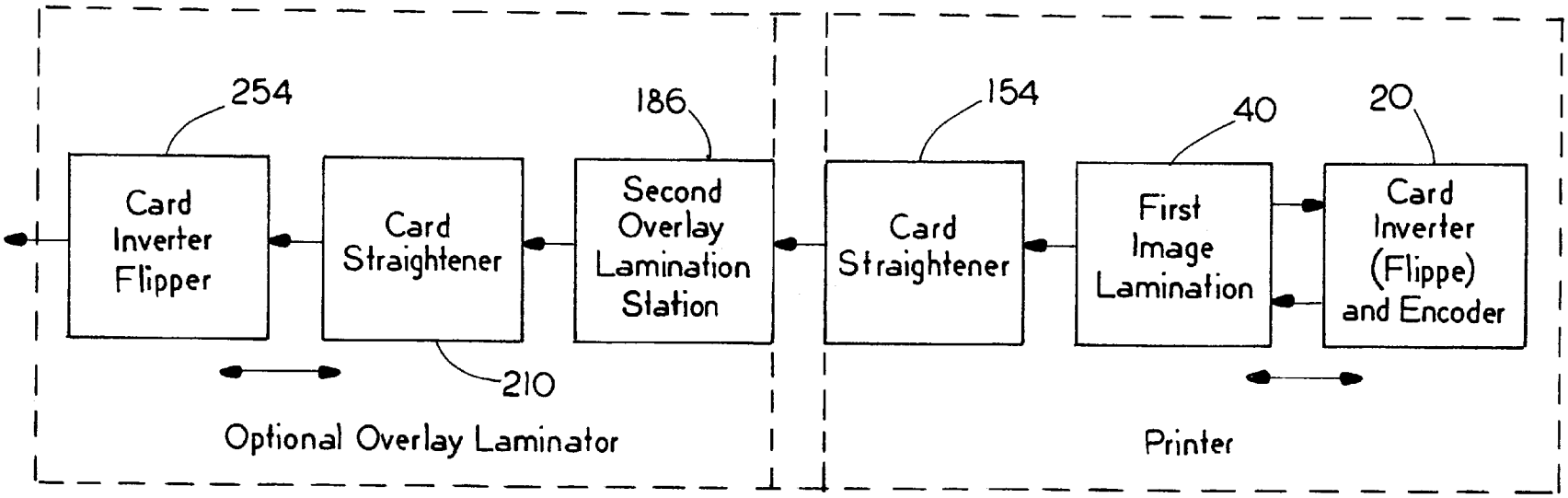
FIG. 15 is a block diagram to illustrate options for handling a card after lamination of an image onto a first side of the card, including inverting the card and laminating an image onto a second side of the card.

FIG. 15 is a schematic representation of operation with an optional overlay lamination and two sided processing of cards. The card or inverter flipper 20 is indicated. It sends card to the lamination station 40. If two sides of a substrate of card are to be printed, the driver can be reversed, and the card can be transferred back to inverter or flipper 20, which will invert the card, under suitable control from the controller 58. The card can then be fed back to the lamination station 40, and an image from intermediate transfer ribbon index properly to the card and laminated on a second side. Then the card, after lamination of a second image on the second side, can be fed to a first card straightener station 154.

The card can then be fed to the overlay lamination station 186 and through a second card straightener 210. A second flipper 254 can be used for feeding the card back into the overlay lamination station 186 for laminating an overlay on the second side of the card, after which the card again would be fed to the second card straightener. The flipper 254 can be between the overlay lamination station and second card straightener 210 so both overlays can be made before straightening. Various components can be considered modules that can be arranged as desired for accommodating the needs for individual cards.

Figure 16:
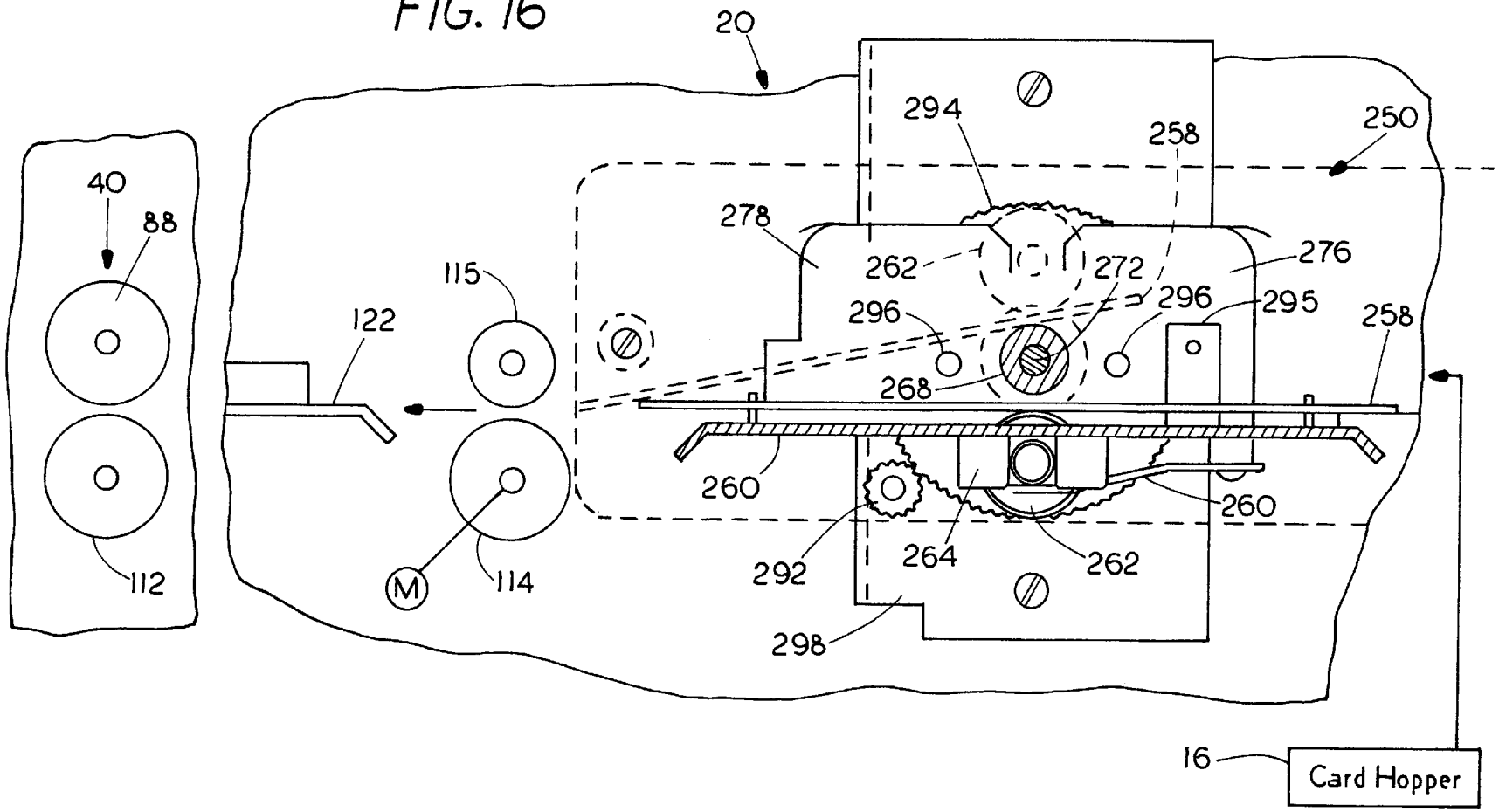
FIG. 16 is a side view of a card inverter or flipper for permitting applying an image to a second side of the card.
Figure 17:
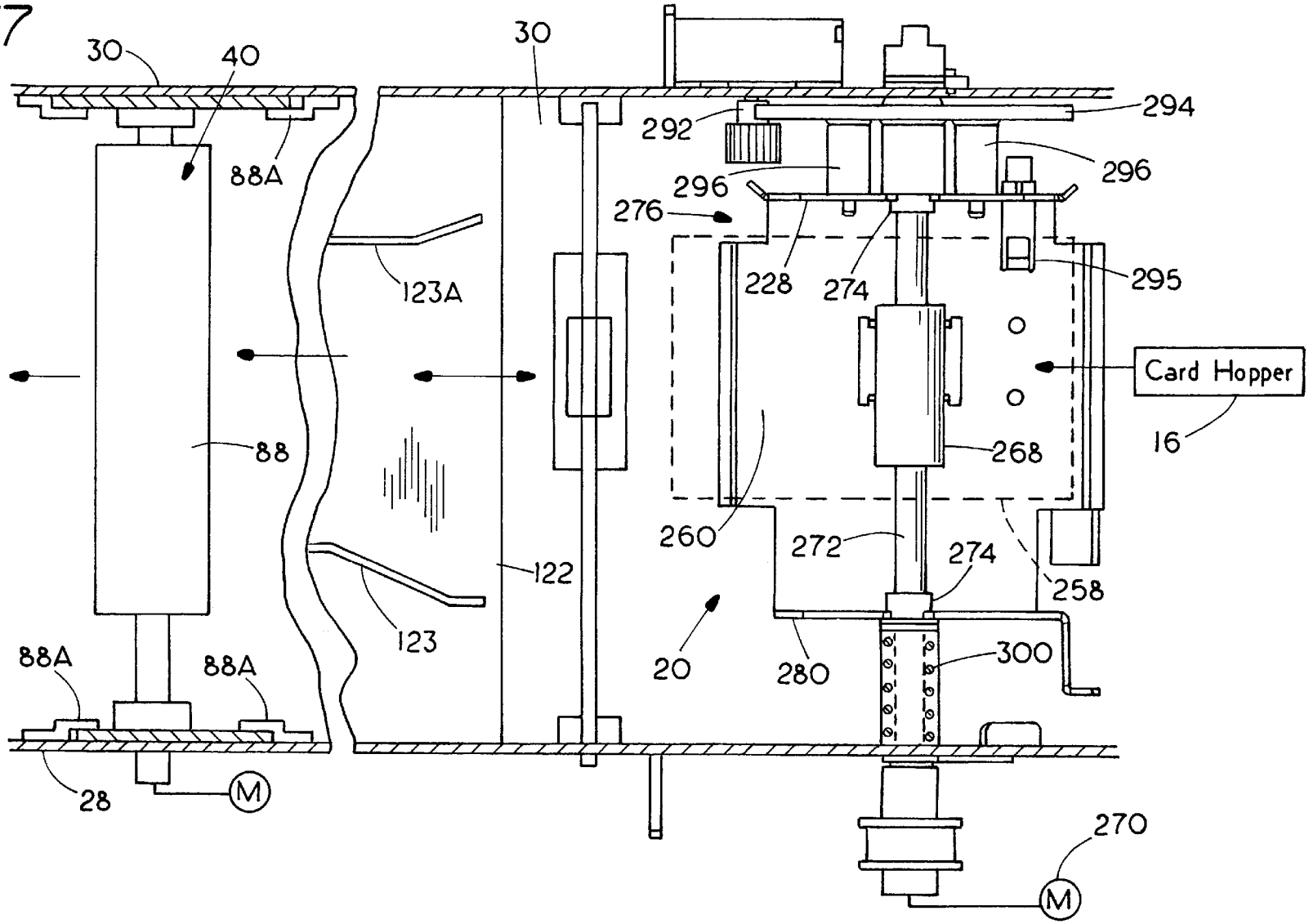
FIG. 17 is a top plan, schematic view of the card inverter of FIG. 16.

In FIGS. 16 and 17, the inverter or flipper station 20 is shown in greater detail, and reference is made to now U.S. Pat. No. 5,941,522, issued Aug. 24, 1999, and entitled "Printer With Auxiliary Operation" assigned to the assignee and incorporated by reference. The inverter or flipper table 20 is described there, as well as in co-pending U.S. patent application Ser. No. 09/310,770, filed May 10, 1999, and entitled "Input Hopper And Encoding Station For Card Printer".

FIG. 16 is a side view of a typical inverter or flipper table that can be used with the present device, and shows a side wall 30 of the base module is used for mounting various components. The lamination station is shown schematically at 40 and feed table 122 is also shown. The lamination station includes the heated roller 88 and the support roller 110. This is only shown schematically for purposes of illustration. The table 122 and drive roller 114 and pinch roller 115 are shown fragmentarily. After a first side of a card is laminated, it can be fed back across the table 122 to inverter or indexer 20.

A card which has had one surface already laminated with an image is illustrated at 258, and has been fed from the lamination station 40 back across feed table 122 by feed roller 114 and pressure roller 115 is held above a support table 260 for the flipper or inverter assembly 20, on a spring loaded pressure roller 262 that is rotatably mounted in a suitable support 264 on the table. A spring 266 urges roller 262 up against a driver roller shown at 268. The driver roller 268 is a roller on a shaft 272 that is driven, as can be seen in FIG. 17, with a suitable motor 270. The shaft 272 for the roller 268 is mounted in suitable bearings relative to a flipper table assembly 276, which includes the support wall 260 and side walls 278 and 280, that are spaced-apart as shown in FIG. 17.

The bearings are shown schematically at 274, and permit the shaft 272 to rotate. The shaft 272 is also supported by rotation relative to the side wall 30 and 28 of the base module. The roller 268 can rotate without rotating the table 260. The position of the table assembly 276 is controlled by a stepper motor 290 that is mounted on the side wall 30 (see FIG. 17) and has a gear 292 that engages a drive gear 294 that is, in turn, drivably connected to the flipper or inverter table side wall 278 through suitable drive pins 296. The table 260 will be held in a desired position when the stepper motor 290 is not driven and yet the shaft 272 can be driven from the motor 270 to drive the drive roller 268 and, in turn, drive the card 258 into a desired position so that it clears the rollers 114 and 115 that drive and guide the card from and to the lamination station 40 along with rollers 118 and 119. Suitable plates 298 are provided for supporting the shaft 272 relative to the side walls 30 and 28.

A sensor 295 can be used on the flipper table assembly 276 for sensing the position of the card 258 so that it is known where the card 258 is located as it enters the flipper table from either end.

A suitable spring 300 also can be used for keeping the table 260 urged toward the side wall 30 to maintain it in its known position.

When the first image is laminated from the intermediate transfer film or web onto the card 258, the card or substrate will be driven by the lamination roller 88, back across the table 122, driving with rollers 118, 119, 114 and 115 in a suitable manner onto the support table 260 where the card or substrate will be engaged and driven by roller 268 when the motor 270 is driven. The card will be held in position on the flipper table 260, essentially as shown in FIG. 16. Then, stepper motor 290 can be driven while motor 270 is stopped (as controlled by controller 58) through its gear arrangement 292 to drive the gear 294 and rotate the table 260 so that it will invert the card 258 and provide it at a suitable angle so that when the card can then be driven in a direction toward the rollers 114 and 115 to table 122 and lamination station 40 by motor 270 (the pressure roller 262 will rotate with the table, and will be above the roller 268). The card 258 will be placed back on table 122 and moved into the lamination station 40. Then the card will have a second image from the intermediate transfer film or web laminated on a second side by heating the lamination roller 88, as previously described.

After that, the card or substrate will have been processed to have images on both sides, and it can then be fed out of the lamination station 40 into either a card straightener, a second lamination station for providing a clear overlay on a first side of the card and, if desired, to an indexer or flipper that will invert the card for having a second clear overlay laminated in place.

The clear overlay segments can be laminated on one or both sides of the card after images have been printed on it simultaneously and at the same location on the printer in order to save space. Another card straightener can be used after the overlay application, as previously explained.

The printer disclosed thus is operated by having individual modules that hinge apart or fold apart to open, and provide access for insertion of two different films or webs, one being the colored panel printer dye sublimation film or web that has individual color panels and requires back and forth movement of the film or web during the printing operation to print an image onto an intermediate transfer film or web. Both the intermediate transfer film or web and the print film or web are supported in separate modules so that they are easily installed by providing access to all of the guide rollers without having to "thread" the film or web under any rollers or through any opening. Using a supply and take-up roll with the films or webs connected between the two, as they are received from the supplier, and then placing the film or web itself on the outside of and around the guides and snapping in the rolls, is all that is needed.

In addition, the combination of a multi-colored printing station or head for printing onto a reverse image film or web, with a station for laminating the image onto a card in one printer assembly is provided by having take-up rollers or dancer rolls that will provide slack in the intermediate transfer film or web between the lamination station and the printing station. This permits the intermediate transfer film or web to move back and forth under the printhead while it does not move the same amount, or even can remain stationary, relative to the lamination station.

Any type of card feeder can be utilized and, in the present form, there is an encoding station for permitting encoding and verification of the card, either by way of a magnetic station, antenna for programming a proximity transceiver, or by programming a chip on the card.

Latches that are used for securing the modules in place are conventional latches, so that the module 32 can be latched into position, relative to the base module 36 and the printer film or web module can be latched onto the transfer film or web module 36 to secure the assembly.

The printer of the present invention will permit batch printing, that is where a series of images are printed by the printhead, carried to the lamination station, and then cards in sequence are printed, or can also be used for single printing, where an image would be printed, and that single image would be transferred to the lamination station, placed onto a card, and then the intermediate transfer film or web would be reversed back up to the printing station and the next portion of the print receptive coating on the intermediate transfer film or web, and the sequence would repeat for individual cards. Further, cards may be sequenced or encoded concurrently with printing, laminating, or laminating with an optional lamination station.

The marks can be sensed, as previously disclosed, and the card and image can be located properly for lamination.

Although the present invention has been described with reference to preferred embodiments, workers skilled in the art will recognize that changes may be made in form and detail without departing from the spirit and scope of the invention.

What is claimed is:

1. A printer for printing on a web that has a transferable print receptive coating, including a printhead for printing on the coating of the web, a processing station processing the web to transfer the coating to a substrate after the web has passed through the printhead, a web drive for moving the web through the printhead in both first and second directions while the processing station retains the web so that the web has slack in a web portion during operations of the printer, and a slack take-up roller for engaging the web at the web portion and being urged in a direction for taking up slack that occurs in the web.

2. The printer of claim 1, wherein there are at least two spaced apart idler rollers guiding the web in the web portion, and wherein said take-up roller comprises a take-up roller that is on an opposite side of the web portion from the idler rollers and that moves between the two idler rollers and engages the web portion a bias member urging the take-up roller toward the web portion to push slack of the web portion into a loop between the two spaced apart idler rollers.

3. The printer of claim 2, wherein said take-up roller comprises a roller mounted on a pair of arms pivotably supported relative to a printer frame.

4. A printer for applying an image onto a substrate including a printhead for causing printing onto a print receptive web supported adjacent the printhead, and passing through a processing station spaced from the printhead after printing, a web drive to move said print receptive web in a first direction from the printhead toward the processing station to cause slack between the printhead and the processing station, and to reverse the direction of movement of the web relative to the printhead and a take-up roller on the printer resiliently engaging the print receptive web between the printhead and the processing station for taking up slack that occurs in the print receptive web.

5. The printer of claim 4, wherein the printhead is an ink jet printhead supported to print on the print receptive web.

6. The printer of claim 4, wherein the printhead is a thermal printhead, a thermal dye sublimation web supported for movement between the printhead and the print receptive web and movably with the print receptive web to print thereon.

7. The printer of claim 6, wherein the dye sublimation web has multiple colored panels for printing multiple colored images on the print receptive web.

8. The printer of claim 5, wherein there are a plurality of ink jet heads supported to print on the print receptive web in sequence in a direction of travel of the print receptive web, said ink jet printheads providing at least two different color printing, and selectively one of the heads providing an ink fixing agent.

9. The printer of claim 4, wherein there are a plurality of the printheads, each of said printheads being a thermal printhead, a separate thermal dye sublimation web supported for movement between each of the respective thermal printheads and the print receptive web, said thermal dye sublimation webs each being a different color than other thermal dye sublimation heads, each of said printheads being controlled to print an image from the respective thermal dye sublimation web onto the same region of the print receptive web to form a multi-color image in such region of the print receptive web.

10. The printer of claim 4, wherein said print receptive web has an image printed thereon that is transferrable to a substrate, said substrate comprising an identification card, and the processing station comprising a lamination station for laminating an image from the print receptive web onto the card, said lamination station utilizing a heated roll for transferring the image to the card, a second lamination station for lamination of a section of clear film over the printed image and card after passing through the first lamination station, said second lamination station including a heated roll for transferring a clear film section from a supply onto the surface of the card carrying the image.

11. The printer of claim 10 and a card inverter station receiving a card from the lamination station, and replacing the card in the lamination station after the card has been inverted for laminating an image on a second side of the card.

12. The printer of claim 10 and a card straightener station for receiving a card from the second lamination station, said card straightener station comprising an assembly that will support the card and provide heat to cause the card to become substantially planar.

13. A printer for applying an image onto a substrate including a printhead for causing printing onto a print receptive web supported adjacent the printhead, and passing through a processing station spaced from the printhead after printing, said print receptive web becoming slack between the printhead and the processing station, and a take-up roller on the printer resiliently engaging the print receptive web between the printhead and the processing station for taking up slack that occurs in the print receptive web, wherein the processing station comprises a lamination station, and said print receptive web having a film that is heat transferrable to a substrate, said lamination station providing heat to transfer an image on the print receptive web onto the substrate.

14. The printer of claim 13 and a pair of plates for receiving the substrate from the lamination station, one of said plates being heated and the other of the plates supporting the substrate to permit the substrate to assume a planar position.

15. The printer of claim 13, wherein the print receptive web receives a reverse image printed thereon, and the lamination station laminates the image onto the substrate such that the image is oriented for reading when laminated onto the substrate.

16. A printer including a print web supply providing a print web, and a printhead for printing material from the print web under a process that requires reversing the direction of the print web and driving the print web in forward direction a plurality of times, a print receptive web movably supported on the printer adjacent the printhead, and passing through a processing station to transfer a printed image therefrom to a substrate, said print receptive web moving with said print web in opposite directions of movement when the printhead is printing an image onto the print receptive web, the print receptive web passing through the processing station at a different speed than the movement of the print web and print receptive web at the printhead, and a biased take-up roller for engaging the print receptive web between the printhead and the processing station for taking up slack that occurs in the print receptive web.

17. The printer of claim 16, wherein the print web is a thermal dye sublimation multi-colored film or web.

18. The printer of claim 16, wherein said take-up roller comprises a roller that is on an opposite side of the print receptive web from and moves between two idler rollers and engages the print receptive web to push web slack into a loop between the two idler rollers.

19. The printer of claim 16, wherein said take-up roller comprises a roller mounted on a pair of arms pivotally supported relative to the printer frame and biased to engage the print receptive web.

20. A printer including a first base support module, a second printing module and a third intermediate transfer web module, the second and third modules being movably mounted to the base support module, one of the second and third modules being mounted over said base module and the other of the second and third modules mounted over the one of the second and third modules in a working position, the second and third modules being movable to provide access to sides thereof facing the base module when the modules are in working position.

21. The printer of claim 20, wherein said second and third modules are hingedly connected to the base module and pivot to positions to expose normally hidden under sides of the second and third modules, and supports for a print web positioned at locations accessible from the under side of the second printing module, and said print web being guided on guides engaged by the print web and exposed from the under side of the printing module over which the print web can be placed.

22. The printer of claim 21, wherein said intermediate transfer module supports the print receptive web, and being hingedly connected to the base module and hinging from its working position to an open position to expose guide rollers forming print receptive web support surfaces open to the underside of said intermediate transfer module for said print receptive web, supports for said print receptive web supply on the intermediate transfer module being accessible when the intermediate transfer module is pivoted to an open position, and said print receptive web being positioned to the exterior of guides carried by said intermediate transfer module to permit installation of said print receptive web supply without threading the print receptive web through enclosed passageways.

23. The printer of claim 20, wherein the second printing module includes a printhead, said print web comprising a dye sublimation print web that is supported across the printhead, the intermediate transfer module supporting an intermediate transfer web comprising a print receptive web, and when the intermediate transfer module is in a working position, the intermediate transfer web being clamped between the printhead and a print platen, and a slack take-up roller on an output side of said printhead for receiving slack intermediate transfer web and maintaining a desired tension therein during a printing operation.

24. The printer of claim 23, wherein said slack take-up roller is mounted on a pivoting arm pivotally mounted relative to the printer, and a spring urging said slack take-up roller to maintain a tension in the intermediate transfer web on an output side of the printhead.

25. The printer of claim 23 and a processing station mounted on said intermediate transfer module, and positioned on an opposite side of said slack take-up roller from said printhead, the processing station including an identification card support, and a heated roller to transfer an image from said intermediate transfer web to an identification card in the processing station.

26. The printer of claim 25 and a pair of guide rollers rotatably mounted on the printer, and having longitudinal axes spaced apart and fixed in position, said slack take-up roller being positioned to move between said guide rollers engage a portion of the intermediate transfer web supported on said guide rollers to take up slack.

27. The printer of claim 20, wherein said second and third modules are hingedly connected relative to the base module, and a latch between the base module and the second module, and between the third module and the second module to latch the modules in working position.

28. The printer of claim 27 and at least one guide pin between the base module and the second module, and the second module and the third module for guiding the modules into position at the time that the latches engage to latch.

29. The printer of claim 20, wherein at least the base module and one of the second and third modules are movably connected together, and a latch member for latching the connected modules in a working position relative to each other.

30. The printer of claim 29 and interfitting guide blocks between the modules that are connected together to guide the connected modules into proper working position.

31. The printer of claim 29, wherein the latch member comprises a separate latch on each of spaced side walls of the base module and the one of the second and third modules, an exterior push button operable for moving both latch members simultaneously to release the latch members for movement between the connected modules.

32. A printer for providing a printed image to a substrate including a printing head for transferring the printed image from a print web onto a surface of an intermediate transfer web, a drive for said intermediate transfer web to move said intermediate transfer web from said printhead to a processing station, said printhead moving said intermediate transfer web during printing at a rate that causes slack to occur between the processing station and the printhead, and a web slack take-up roller for maintaining a tension in said intermediate transfer web as the intermediate transfer web moves relative to the printhead at differing velocities than its movement through the processing station.

33. The printer of claim 32, wherein the printer has a pivoting arm pivotally mounted on the printer and supporting the slack take-up roller, and a biasing force tending to move said pivoting arm about its pivot to move the slack take-up roller in a selected direction to engage the intermediate transfer web.

34. The printer of claim 33 including a pair of rotatable guide rollers on the printer that are spaced apart and substantially parallel, said intermediate transfer web passing between said guide rollers, and said slack take-up roller being urged to move between said guide rollers and engage the intermediate transfer web passing between the guide rollers and to move the intermediate transfer web between the guide rollers to take up slack.

35. The printer of claim 34 including three rotatable rollers that are parallel and spaced to form two gaps between adjacent ones of the three rollers, one of the webs passing across the three rollers with the three rollers on one side of the one web, a support movably mounted on the printer mounting the slack take up roller, and a second slack take-up roller, to form a pair of slack take up rollers which pass into the two gaps under a bias force and move the one web into a separate loop at each of the two gaps.

36. The printer of claim 35 wherein the support comprises a pair of spaced pivoting arms having fingers extending therefrom, the slack take-up rollers being mounted on the fingers, and the fingers being of size to pass through the gaps, and a bias force urging the arm to pivot and urge the rollers against the one web.

37. A printer for applying an image onto a substrate including a printhead for causing printing onto a print receptive web supported adjacent the printhead, a drive for moving the print receptive web through a processing station spaced from the printhead after printing, the printhead printing individual images on a section of the print receptive web, the processing station comprising a lamination station for laminating the image in the section onto a separate substrate of size to receive the image, a first sensor for sensing the presence of an image on the print receptive web, said first sensor being adjacent the lamination station, a second sensor for sensing the presence of a substrate, and a controller for coordinating the movement of the substrate and the image sensed into the lamination station to register the image on the substrate.

38. The printer of claim 37, wherein the section comprises a first section and a drive for reversing said print receptive web, to position a trailing edge of the section on which the image transferred to the substrate was located adjacent the printhead, and printing a second image on a section of the print receptive web adjacent the first section.

39. The printer of claim 37, wherein said printhead prints a number of images on identifiable sections in sequence on the print receptive web, and a feeder for sequentially feeding a number of substrates provided in sequence registered with the each succeeding section of the print receptive web carrying an image prior to entering the lamination station.

40. The printer of claim 37, wherein said lamination station has a heated roll that engages the print receptive web and transfers the image to the substrate by heating the web while in contact with the substrate.

41. The printer of claim 40, wherein the lamination station is a first lamination station, and a second lamination station to receive the substrate after the image has been transferred thereto in the first lamination station, a web carrying clear material segments for forming an overlying film on substrates carrying the image from the first lamination station, the second lamination station having a heated roll for laminating a clear material segment onto the surface of the substrate.

42. The printer of claim 41 and at least one substrate straightener following one of the lamination stations for heating the card while resting on a planer support for permitting the substrate to soften and assume a planer position.

43. The printer of claim 37 and a substrate inverter for inverting the substrate after the substrate has been processed a first time in the lamination station, a drive for moving the substrate onto the substrate inverter and back into the lamination station for laminating a second side of the substrate with a second image.

44. The printer of claim 43, wherein the lamination station is a first lamination station, and a second lamination station to receive the substrate after the images have been transferred to the lamination side of the substrate, a web carrying clear material segments for forming an overlying film on substrates carrying the image from the first lamination station, the second lamination station having a heated roll for laminating a clear material segment onto one surface of the substrate, and a substrate inverter for inverting the substrate after a clear material segment has been laminated onto a surface of the substrate, and moving the substrate into the second lamination station for laminating a clear material segment onto a second surface of the substrate.

* * * * *

UNITED STATES PATENT AND TRADEMARK OFFICE

CERTIFICATE OF CORRECTION

PATENT NO. : 6,261,012 B1 
DATED : July 17, 2001
INVENTOR(S) : Darren W. Haas et al.

It is certified that error appears in the above-identified patent and that said Letters Patent is hereby corrected as shown below:

Title page,
Item [56], References Cited, cancel the last reference listed as "3,879,924" and insert -- 3,879,246 --.

Signed and Sealed this

Third Day of December, 2002

JAMES E. ROGAN
*Director of the United States Patent and Trademark Office*